US006347209B1

(12) United States Patent
Bessho

(10) Patent No.: US 6,347,209 B1
(45) Date of Patent: Feb. 12, 2002

(54) ELECTRIC CHARGE DEVICES FOR AN IMAGE FORMING APPARATUS

(75) Inventor: Yuji Bessho, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/464,079

(22) Filed: Dec. 16, 1999

(30) Foreign Application Priority Data

Dec. 18, 1998 (JP) ..... 10-376011
Dec. 18, 1998 (JP) ..... 10-376012

(51) Int. Cl.[7] ..... G03G 15/01; G03G 15/16
(52) U.S. Cl. ..... 399/303; 399/312
(58) Field of Search ..... 399/303, 308, 399/312, 313, 314

(56) References Cited

U.S. PATENT DOCUMENTS 4,171,157 A * 10/1979 Suzuki ..... 399/313
5,321,477 A * 6/1994 Nagata et al. ..... 399/312

* cited by examiner

*Primary Examiner*—Quana M. Grainger
(74) *Attorney, Agent, or Firm*—Fitzpatrick, Cella, Harper & Scinto

(57) ABSTRACT

An image forming apparatus includes an image bearing member for bearing an image, a recording material bearing member for bearing a recording material, a first charge supplying device for supplying an electric charge having a predetermined polarity onto an opposite side of a surface on which the recording material is borne by the recording material bearing member in order to electrostatically transfer the image on the image bearing member to the recording material, and a second charge supplying device for supplying an electric charge onto an opposite side of the surface on which the recording material is borne by the recording material bearing member prior to the recording material is borne by the recording material bearing member, wherein, in a direction substantially perpendicular to a recording material conveying direction, the second charge supplying device supplies an electric charge to the intermediate transfer member in such a way that a charge amount of a second area outside a first area becomes greater than a charge amount of the first area in which the recording material is borne by the recording material bearing member toward the predetermined polarity of the electric charge supplied by the first charge supplying device.

89 Claims, 18 Drawing Sheets

EFFECTIVE TRANSFER CHARGE AREA
NO RECORDING MATERIAL PASSING PORTION
RECORDING MATERIAL PASSING PORTION
NO RECORDING MATERIAL PASSING PORTION
RECORDING MATERIAL BEARING SURFACE

TRANSFER BELT

TRANSFER BELT

TRANSFER BELT

ELECTRIC CHARGE DEVICES FOR AN IMAGE FORMING APPARATUS

BACKGROUND OF THE INVENTION

1. Field of the Invention

The present invention relates to an image forming apparatus for forming an image on a recording material by using an electrophotographic process, for example, an image forming apparatus such as a copier, a printer, or a facsimile.

2. Related Background Art

Conventionally, there have been suggested or worked various image forming apparatuses using an electrophotographic process. For example, there are an image forming apparatus in which toner images formed on a photosensitive drum are sequentially transferred and superposed on top of one another on a recording material which is conveyed with being borne by a transfer drum or by a transfer belt and an image forming apparatus in which toner images formed on a photosensitive drum are primarily transferred and sequentially superposed on top of one another on an intermediate transfer drum or on an intermediate transfer belt and then the toner images on the intermediate transfer drum or on the intermediate transfer belt are secondarily transferred to a recording material. The image forming apparatuses using these two methods will be described below.

Simply describing the image forming process of an image forming apparatus in which the former method (a transfer belt) is used, first a photosensitive drum rotates so as to be uniformly charged on its surface by a charger. Next, the photosensitive drum is irradiated with a laser beam modulated by an image signal of a first color, for example, magenta of an original so as to form an electrostatic latent image of magenta on the photosensitive drum. The electrostatic latent image is developed by a magenta developing unit so as to form a magenta toner image of the first color on the photosensitive drum.

On the other hand, the recording material in a sheet feeding cassette is conveyed to the transfer belt by a registration roller or the like. Simultaneously with this recording material conveyance, an adsorbing roller is pressed to a surface of the transfer belt so that the transfer belt is charged by an adsorbing charger from a back side of the transfer belt in order to adsorb the recording material electrostatically onto the transfer belt. This transfer belt is rotating in synchronism with the photosensitive drum and the magenta toner image formed on the photosensitive drum by the transfer charger is transferred to the recording material borne by the transfer belt. The transfer belt continues its rotation without change to prepare for a transfer of a cyan toner image of the subsequent second color.

Next, the cyan toner image of the second color is formed on the photosensitive drum and the cyan toner image is transferred and superposed on the magenta toner image on the recording material borne by the transfer belt. The same image forming process is repeated also for the third and fourth colors yellow and black to obtain a full color image in which four-colored, magenta, cyan, yellow, and black toner images are superposed on each other on the recording material.

The recording material to which the four-colored toner images have been transferred is separated from the transfer belt and conveyed to a fixing device. The fixing device heats and presses the toner image and the recording material by a fixing roller and a pressure roller to mix respective colors of the toner image and to fix it to the recording material, by which a full-color print image is formed and then the recording material is discharged to an outside of the apparatus.

Briefly describing the image forming process of an image forming apparatus using the latter method (an intermediate transfer belt), a photosensitive drum is driven to rotate at a predetermined peripheral speed so as to be uniformly charged on its surface by a charger and is exposed to a laser beam with scanning by an exposing device, by which an electrostatic latent image of a first color is formed on the photosensitive drum and then the latent image is developed by a developing device. The developing device contains four developing units for yellow toner, magenta toner, cyan toner, and black toner, respectively. The electrostatic latent image of the first color on the photosensitive drum is developed by a yellow developing unit so as to be visualized as a yellow toner image.

The formed yellow toner image is electrostatically transferred to an intermediate transfer belt in a primary transfer portion where the intermediate transfer belt is put in contact with the photosensitive drum (a primary transfer). Toner remaining on the photosensitive drum which has been completed to be primarily transferred is removed from its surface by a cleaner and then the photosensitive drum is supplied to the next color image formation.

In the same manner, the photosensitive drum is charged by the charger and is exposed to a laser beam to form a second color electrostatic latent image, and then the latent image on the photosensitive drum is developed by a magenta developing unit to form a magenta toner image on the photosensitive drum. The magenta toner image is transferred and superposed on the yellow toner image on the intermediate transfer belt.

The above process is repeated also for cyan and black and respective toner images are sequentially superposed on the intermediate transfer belt for transfers. Thereby a color image is formed with four-colored, yellow, magenta, cyan, and black toner images laminated on the intermediate transfer belt.

Afterward a secondary transfer charger which has been spaced from the intermediate transfer belt is made to abut against a surface of the intermediate transfer belt, and in a secondary transfer portion where the intermediate transfer belt is in contact with the secondary transfer charger, toner images of the four colors on the intermediate transfer belt are collectively transferred to a surface of a recording material conveyed at a predetermined timing (a secondary transfer).

The recording material to which the toner images of the four colors have been transferred is conveyed from the intermediate transfer belt to a fixing device, where it is subjected to a fixing process with a heat roller or the like so as to make a full-color permanent image and then discharged to an outside of the image forming apparatus.

In the transfer process of the image forming apparatus in the former and the primary transfer process and the secondary transfer process of the image forming apparatus in the latter, a constant current power supply is connected to the transfer charger, the primary transfer charger, and the secondary transfer charger to control the transfer current at constant current from a viewpoint of a stability of the image transfer.

In the former image forming apparatus, however, poor transferring may occur as described below.

In this image forming apparatus, an image can be formed on a recording material having a smaller size than the applicable maximum size (in a length in a direction perpendicular to a recording material conveying direction). At this point, a volume resistivity of the recording material varies within a range of approx. $2\times10^7$ to $10^{14}$ Ωcm according to a type of the recording material or hygroscopic conditions.

If a recording material having the applicable maximum size is passed for a transfer by using the transfer belt as shown in FIG. 12, assuming that Itr[μA] is transfer current from the transfer charger, χ[cm] is a width of the recording material (a length in a thrust direction perpendicular to a transfer belt moving direction), and v[cm/s] is a rotating speed of the photosensitive drum, that is, a process speed, the transfer current flowing in Δt sec is Itr×Δt and a target area for the recording material is v×Δt×χ in this condition as shown in FIG. 13, and therefore the surface charge density on the recording material is expressed as follows:

$$Itr\times\Delta t/(\chi\times\Delta t\times v)=Itr/(\chi\cdot v)[\mu C/cm^2]$$

While the recording material has a relatively very high volume resistivity in an ordinary temperature and low humidity environment (for example, 23° C., 5% RH), a surface charge density on the maximum-sized recording material having the maximum width does not change in the constant current method even in such a condition.

On the other hand, if a small-sized recording material having a short width is passed as shown in FIG. 14, assuming that Iχ is electric current flowing through a part of a recording material, Iw and Iz are electric current flowing through no recording material passing portions in both sides of the recording material, respectively, χ is a width of the recording material, and w and z are width of no recording material passing portions, respectively, a recording material passing portion has a resistance of the recording material itself though the surface charge density on the recording material and on the no recording material passing portion must be intrinsically the same as that in passing the maximum-sized recording material (in other words, $Iw/(w\cdot v)=I\chi/(\chi\cdot v)=Iz/(z\cdot v)$) and therefore its impedance is relatively high in comparison with the no recording material passing portion, by which electric current per unit area flowing through the recording material passing portion is smaller than that of the no recording material passing portion and also a surface charge density on the recording material becomes smaller than that of the no recording material passing portion.

Therefore, in the constant current method, the surface charge density on the recording material does not satisfy a necessary and sufficient condition (in other words, $Iw/(w\cdot v)=Iz/(z\cdot v)>I\chi/(\chi\cdot v)$), thus causing poor transferring.

It remarkably occurs, for example, when an image is transferred to a recording material having a high resistance increased due to dryness or when the transfer belt has a low resistance decreased due to moisture absorption in a high-temperature and high-humidity environment (for example, 30° C., 80% RH).

A surface potential of a portion corresponding to the no recording material passing portion of the photosensitive drum is normally the same as a potential (Vd) of a no image portion which is a high-potential portion of the photosensitive drum as shown in FIG. 15 in order to prevent toner from adhering to the surface in developing. In this condition, if a small-sized recording material is passed in this constant current method, a lot of electric current flows into the no recording material passing portion having a large difference of potentials and electric current flowing through the recording material passing portion becomes insufficient, thus causing poor transferring.

Accordingly if a transfer bias is set in such a way that sufficient electric current flows into the recording material passing portion when a small-sized recording material is passed, to the contrary, excess electric current flows on passing a recording material having the maximum width, still causing poor transferring due to inversely charging of toner.

Also in the latter image forming apparatus, there have been problems in the primary transfer and the secondary transfer as described below when an image is formed on a recording material such as a postcard or an envelope having a smaller size in width than the maximum size.

First, problems in the primary transfer will be described below. A schematic diagram of the primary transfer portion is shown in FIG. 24.

In general, an impedance of an image portion is higher than that of a no image portion in the primary transfer since toner itself has a high resistance (approx. $10^{15}$ Ωcm). Therefore in a constant current control, as an image ratio (assuming that y is a length in a thrust direction of the image portion and g is the maximum size recording width, the image ratio (%)=$y/g\times100$, $0\leqq y\leqq g$) is lowered, a ratio of transfer current flowing into the image portion (toner portion) is decreased as shown in FIG. 25 and a ratio of transfer current flowing into the no image portion is increased. It causes a problem that a primary transfer efficiency decreases. This problem remarkably occurs in forming an image on a recording material such as a postcard or an envelope having a smaller size in width than the maximum size recording width.

Referring to FIG. 26, there is shown a state of the primary transfer portion when an image is formed onto a small-sized sheet. In FIG. 26 assuming that y is a length in the thrust direction of the image portion, g is the maximum size recording width, and a is a small-sized sheet width, $0\leqq y\leqq a<g$ and therefore the image ratio ($y/g\times100$) is always low. In other words, when an image is formed on a small-sized sheet, an image is not formed on a portion (g−a) corresponding to a no recording material passing portion in the primary transfer portion and therefore an image ratio is always low, thereby transfer current is always insufficient.

Furthermore, a surface potential of the photosensitive drum corresponding to a no recording material passing portion of the intermediate transfer belt is normally equal to a potential (vd) of the no image portion which is a high potential portion as shown in FIG. 27 so as to prevent toner from adhering to the surface in developing. Thereby in the constant current method, a large amount of electric current flows through the no recording material passing portion and the no image portion having a large potential difference at the primary transfer and electric current flowing through the image portion becomes insufficient, thereby causing poor transferring.

If a primary transfer bias is set in such a way that sufficient electric current flows through the image portion when an image is formed on a small-sized recording material to the contrary from this viewpoint, excess electric current flows in the primary transfer portion when an image is formed on a recording material having the maximum width this time and toner is inversely charged, thereby causing poor primary transferring. In addition if the primary transfer bias is controlled at a constant voltage, a very high transfer voltage is required to feed the image portion with necessary and sufficient transfer current and electric current flowing into the no image portion significantly increases, thereby being attended by an evil causing a memory phenomenon on the photosensitive drum.

Problems in the secondary transfer will be described below. In the secondary transfer portion, a constant current method is generally used as described above. The constant current method, however, has problems described below.

Generally this type of an apparatus normally treats recording materials having a smaller size than the applicable maximum size. In addition, a volume resistivity of recording materials varies within a range of approx. $2\times10^7$ to $10^{14}$ Ωcm according to a type of the recording material or hygroscopic conditions.

As shown in FIG. 28, if a recording material having the applicable maximum size is passed by the intermediate transfer belt for the secondary transfer, assuming that Itr [μA] is transfer current from a transfer charger, χ[cm] is a width of a recording material (a width in a thrust direction perpendicular to an intermediate transfer belt moving direction), and v[cm/s] is a rotating speed of the photosensitive drum, that is, a process speed, the transfer current flowing in Δt sec is Itr×Δt and a target area of the recording material is v×Δt×χ in this condition as shown in FIG. 29, and therefore the surface charge density on the recording material is expressed as follows:

$$Itr\times\Delta t/(\chi\times\Delta t\times v)=Itr/(\chi\cdot v)[\mu C/cm^2]$$

While the recording material has a very high volume resistivity in an ordinary temperature and low humidity environment (for example, 23° C., 5% RH), a surface charge density on the maximum-sized recording material does not change in the constant current method even in such a condition.

On the other hand, if a small-sized recording material is passed as shown in FIG. 30, assuming that Iχ is electric current flowing through a part of the recording material, Iw and Iz are electric current flowing through no recording material passing portions in both sides of the recording material, respectively, χ is a width of the recording material, and w and z are widths of the no recording material passing portions, respectively, a recording material passing portion has a resistance of the recording material itself though the surface charge density on the recording material and on the no recording material passing portion must be intrinsically the same as that in passing the maximum-sized recording material (in other words, $Iw/(w\cdot v)=I\chi/(\chi\cdot v)=Iz/(z\cdot v)$) and therefore its impedance is relatively high in comparison with the no recording material passing portion, by which electric current per unit area flowing through the recording material passing portion is smaller than that of the no recording material passing portion and also a surface charge density on the recording material is smaller than that of the no recording material passing portion.

Therefore, in the constant current method, the surface charge density on the recording material does not satisfy a necessary and sufficient condition (in other words, $Iw/(w\cdot v)=Iz/(z\cdot v)>I\chi/(\chi\cdot v)$), thus causing poor transferring.

It remarkably occurs, for example, when an image is transferred to a recording material having a high resistance increased due to dryness or when the intermediate transfer belt has a low resistance decreased due to moisture absorption in a high-temperature and high-humidity environment (for example, 30° C., 80%RH).

SUMMARY OF THE INVENTION

Therefore it is an object of the present invention to provide an image forming apparatus capable of preventing poor transferring from occurring when an image is transferred from an image bearing member to a recording material borne by a recording material bearing member.

It is another object of the present invention to provide an image forming apparatus capable of preventing poor transferring from occurring when an image is transferred from an image bearing member to an intermediate transfer member.

It is still another object of the present invention to provide an image forming apparatus capable of preventing poor transferring from occurring when an image is transferred from an intermediate transfer member to a recording material.

These and other objects, features and advantages of the present invention will become more apparent upon consideration of the following description of the preferred embodiments of the present invention taken in conjunction with the accompanying drawings.

DESCRIPTION OF THE PREFERRED EMBODIMENTS

Embodiments according to the present invention will be described below by referring to accompanying drawings.

First Embodiment

Figure 1:
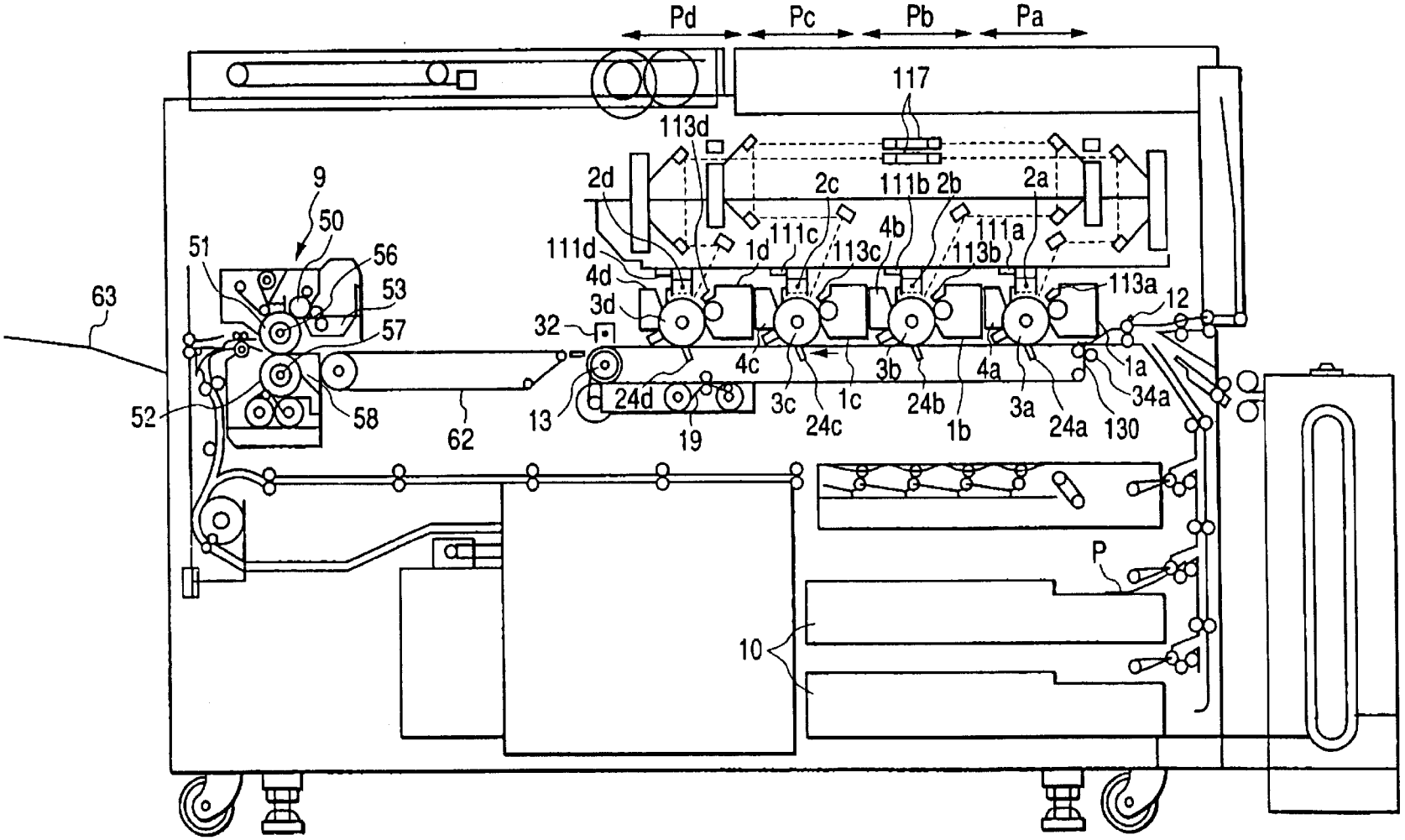
FIG. 1 is a constitutional diagram showing an image forming apparatus to which the present invention is applicable.

As shown in FIG. 1, first, second, third, and fourth image forming portions Pa, Pb, Pc, and Pd are arranged in a line in an apparatus, and toner images of colors different from each other are formed in the respective image forming portions Pa to Pd through latent image formation, development, and transfer processes.

The image forming portions Pa, Pb, Pc, and Pd include dedicated image bearing members or electrophotographic photosensitive drums 3*a*, 3*b*, 3*c*, and 3*d*, respectively in this embodiment, and respective color toner images are formed on the photosensitive drums 3*a*, 3*b*, 3*c*, and 3*d*. A transfer belt 130 of a recording material bearing member is arranged so as to be adjacent to the photosensitive drums 3*a*, 3*b*, 3*c*, and 3*d* and the toner images of the respective colors formed on the photosensitive drums 3*a*, 3*b*, 3*c*, and 3*d* are transferred and superposed on top of each other on a recording material P conveyed and borne by the transfer belt 130.

The recording material P to which the toner images of the respective colors have been transferred is subjected to fixing of the toner images by a fixing device 9 with heating and pressurizing and then discharged to an outside of the apparatus as a color recording image.

In outer peripheral portions of the photosensitive drums 3*a*, 3*b*, 3*c*, and 3*d*, there are provided exposing lamps 111*a*, 111*b*, 111*c*, and 111*d*, drum chargers 2*a*, 2*b*, 2*c*, and 2*d*, electrostatic voltmeters 113*a*, 113*b*, 113*c*, and 113*d*, developing units 1*a*, 1*b*, 1*c*, and 1*d*, transfer chargers 24*a*, 24*b*, 24*c*, and 24*d*, and cleaners 4*a*, 4*b*, 4*c*, and 4*d*. Further in upper portions of the apparatus, there are provided a light source unit which is not shown and a polygon mirror 117.

A laser beam generated from the light source unit is rotated by the polygon mirror 117 for scanning and a luminous flux of the scanning light is deflected by a reflecting mirror and then condensed in generatrix directions of the photosensitive drums 3*a*, 3*b*, 3*c*, and 3*d* by an fθ lens for an exposure, by which electrostatic latent images are formed on the photosensitive drums 3*a*, 3*b*, 3*c*, and 3*d* according to image signals.

The developing units 1*a*, 1*b*, 1*c*, and 1*d* are filled with a predetermined amount of cyan, magenta, yellow, and black toner as developers, respectively, each having a negative polarity as a normal charging polarity, being supplied by supplying devices which are not shown. The developing units 1*a*, 1*b*, 1*c*, and 1*d* are used to develop latent images on respective photosensitive drums 3*a*, 3*b*, 3*c*, and 3*d* so as to visualize them as a cyan toner image, a magenta toner image, a yellow toner image, and a black toner image.

A recording material P is contained in a recording material cassette 10. The recording material P is then supplied onto the transfer belt 130 through a plurality of conveying rollers and a registration roller 12 and sequentially sent to a transfer portion opposite to the photosensitive drums 3*a*, 3*b*, 3*c*, and 3*d* by the transfer belt 130.

The transfer belt 130 is made of a sheet of dielectric resin such as polyethylene terephthalate resin (PET), polyvinilidene fluoride resin, or polyurethane resin, having an endless configuration with its both ends superposed on each other being bonded or having a seamless belt configuration.

If this transfer belt 130 is confirmed to be in a predetermined position after being rotated by a driving roller 13, the recording material P is sent out from the registration roller 12 to the transfer belt 130 and conveyed to the transfer portion of the first image forming portion Pa. Simultaneously with it, an image write signal is set on and an image is formed on the photosensitive drum 3*a* of the first image forming portion Pa at a timing on the basis of the signal.

Then a transfer charger 24*a* applies an electric field or electric charges in the transfer portion in the lower side of the photosensitive drum 3*a*, by which the color toner image of the first color formed on the photosensitive drum 3*a* is transferred to the recording material P. With this transfer, the recording material P is fixedly borne by the transfer belt 130 with an electrostatic adsorbing force and conveyed to the second image forming portion Pb and subsequent image forming portions.

As the transfer charger 24 (24*a* to 24*d*), there can be used a non-contacting charger such as a corona-discharge type or contacting charger with a transfer member such as a conductive blade, roller, or brush. The non-contacting charger has problems that it generates ozone and that it is susceptible to changes in an atmospheric temperature and humidity environment due to charging through an air by which an image cannot be formed stably. There are no such problems in the contacting charger, having such merits that it is ozoneless, resistant to changes in an atmospheric temperature and humidity environment, and useful to obtain high image qualities. In this embodiment, a contacting charger is applied to the transfer charter 24.

Image formation and transfer processing is performed in the same manner as for the first image forming portion Pa also in the second to fourth image forming portions Pb to Pd. Subsequently regarding the recording material P to which the toner image having four colors has been transferred, its electrostatic adsorbing force is attenuated by eliminating residual charges with a separating charger 32 in a downstream portion in a conveying direction of the transfer belt 130, by which the recording material P is separated from the end portion of the transfer belt 130. Normally a driving roller 13 is grounded for a stable separation. The separating charger 32 eliminates residual charges of the recording material P in a state that a toner image is not fixed yet, and therefore a non-contacting charger is used for it.

The recording material P which has separated from the transfer belt 130 is conveyed to a fixing device 9 by a conveying portion 62. The fixing device 9 comprises a fixing roller 51, a pressure roller 52, a heat-resistant cleaning member for cleaning each thereof, heaters 56 and 57 arranged in the rollers 51 and 52, an application roller 50 for applying molding lubricant oil such as demethyl silicone oil to the fixing roller 51, its oil reservoir 53, and a thermistor 58 for sensing a temperature of a surface of the pressure roller 52 to control a fixing temperature.

For the recording material P to which the four-color toner image has been transferred, the colors of the toner image are mixed and fixed to the recording material P by a fixing process, by which a full-color copy image is formed and the recording material P is discharged to a discharge tray 63.

The photosensitive drums 3*a*, 3*b*, 3*c*, and 3*d* having completed the transfer are continuously prepared for the subsequent latent image formation and its following processes after their transfer residual toner is cleaned to be removed by respective cleaners 4*a*, 4*b*, 4*c*, and 4*d*. Residual toner and other contaminants on the transfer belt 130 are scraped off by making a cleaning web (nonwoven fabric) 19 abut against a surface of the transfer belt 130.

The transfer belt 130 used for the image forming apparatus having the above constitution is a dielectric sheet such as a PET sheet, a polyvinilidene fluoride resin sheet, or a polyurethane sheet as described above and its volume resistivity is preferably within a range of $10^{13}$ to $10^{17}$ Ωcm. The transfer charger is known for its stability of images at constant appropriate current (transfer current) contributing to the transfer, and therefore preferably a constant current power supply is connected for a constant current control so as to obtain constant current even if the volume resistivity changes according to a type of the recording material (a thickness, a quality of material, etc.) or hygroscopic conditions; this embodiment requires a transfer voltage of several kV to 10 and several kV.

An image forming apparatus for a multi-transfer requires a greater transfer voltage in comparison with the previous transfer in each transfer stage; particularly the last (the fourth color) transfer requires a rather high transfer voltage in comparison with the first (the first color) transfer.

As a dielectric sheet material for the transfer belt 130, it is also possible to use a film sheet of engineering plastic as well as the above material, such as PET, polyacetal, polyamide, polyvinyl alcohol, polyether ketone, polystyrene, polybutylene terephtalate, polymethylpentene, polypropylene, polyethylene, polphenylene sulfide, polyurethane, silicone resin, polyamide-imide, polycarbonate, polyphenylene oxide, polyether sulfone, polysulfone, aromatic polyester, polyether imide, or aromatic polyimide.

In this embodiment, a polyimide resin is used from a viewpoint of mechanical characteristics, electrical characteristics, and incombustibility. It is seamless-typed having a volume resistivity of $10^{16}$ Ωcm and a thickness of 100 μm.

There are provided driving means for driving the transfer belt and detecting means for detecting a width of the recording material with a process speed (a moving speed of the transfer belt) of 100 mm/sec.

The contacting transfer charger 24 (24*a* to 24*d*) has a transfer member of a plate-shaped conductive rubber (blade) extending in a direction (in a thrust direction) perpendicular to a recording material conveying direction and this transfer member is pushed to the photosensitive drum 3 (3*a* to 3*d*) via the transfer belt 130. A voltage having an opposite polarity (plus in this embodiment) to a normal charging polarity of toner is applied to the transfer charger 24 and a toner image on the photosensitive drum 3 is electrostatically transferred to a surface of the recording material P. In this embodiment, electric current flowing through the transfer charger 24 is controlled at constant current so as to achieve 10 μA of transfer current.

The separating charger 32, which is arranged in an upper portion of the most downstream portion of the transfer belt 130, in other words, above the driving roller 13 for the transfer belt 130, has an electric discharging wire. The electric discharging wire is suspended in the thrust direction with its tension maintained by a spring arranged at one end portion of the electric discharging wire. Power is supplied to the electric discharging wire from a connector in a main body of the apparatus via a power supply terminal, a power supply pin, and a spring which are not shown.

The driving roller 13 is connected to a ground for the main body, having a function of an opposite electrode of the electric discharging wire. In this embodiment, there is a distance of 50 mm between the transfer charger 24*d* of the image forming portion Pd in the final stage and the separating charging portion and 10 kVpp of an AC voltage is applied to the separating charger 32.

In the image forming apparatus in the above electrophotographic process, a length of the transfer member of the transfer charger 24 in the thrust direction is generally a little longer than a width of the maximum size recording material (a length in the same direction as the above thrust direction) so as to cover the maximum size recording material. If a small-sized recording material is passed, however, a surface charge density of the recording material is insufficient as described above, thus causing poor transferring. This phenomenon is described in detail below.

Figure 2:
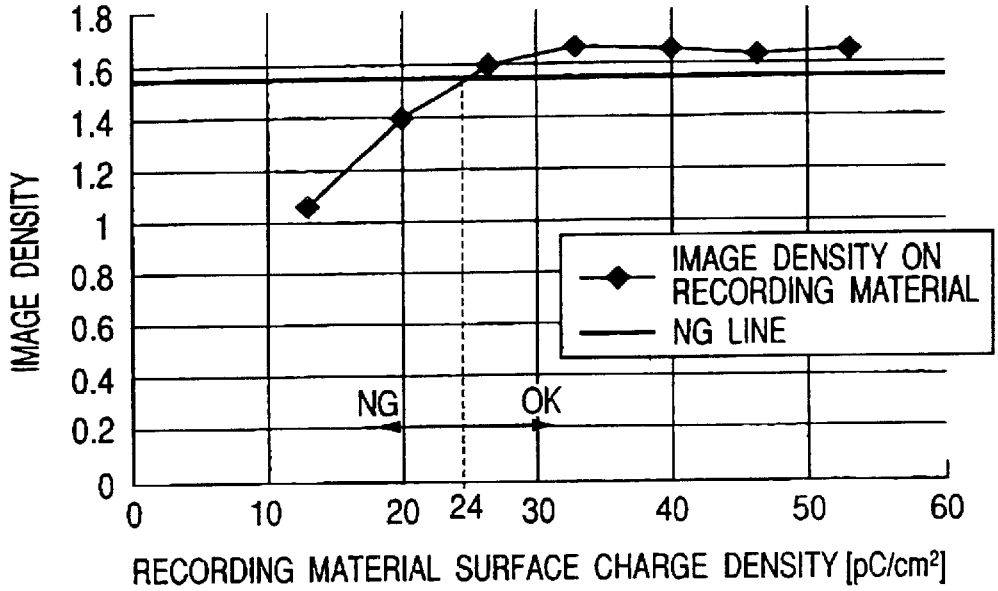
FIG. 2 is a diagram showing a relationship between a surface charge density on a recording material and an image density.

Referring to FIG. 2, there is shown a correlation between a surface charge density of a recording material in a transfer and an image density (a reflective density) transferred to the recording material. It shows that the image density of the recording material is going up as the surface charge density of the recording material is increased. To prevent a defective image from being generated, a 1.55 or greater reflective density is required and the surface charge density of the recording material need be at least 24 pC/cm$^2$ based on FIG. 2.

A surface charge density of a maximum size recording material which has been passed in the constitution of this embodiment is expressed in the following formula based on the above formula since transfer current Itr=10 $\mu$A, a thrust width of the recording material $\chi$=30 cm, and a process speed v=10 cm/s:

$$Itr/(\chi \cdot v)=10/(30\times 10)=1/30\ [\mu C/cm^2]$$

It is apparently a charge amount fully satisfying the condition of the 1.55 or greater reflective density.

If an image is formed on a small-sized recording material, however, it has been experimentally evidenced that a surface charge density of the recording material is 24 pC/cm$^2$ or lower, thus causing a insufficient density. This phenomenon will be described in further detail below by using a calculation.

Figure 3:
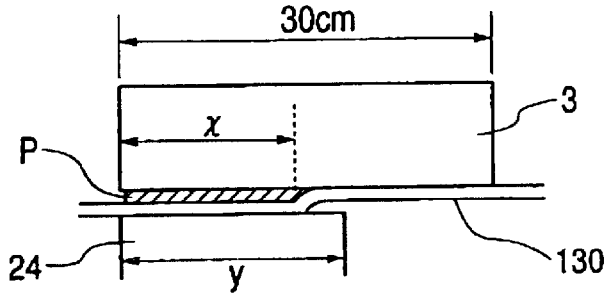
FIG. 3 is a sectional view showing a transfer portion on transferring a small-sized sheet.

Referring to FIG. 3, there is shown a section of a transfer portion when a small-sized recording material has been passed. In FIG. 3, there are provided a film thickness $t_D$ [$\mu$m] of a photosensitive layer and a volume resistivity $\rho_D$ [$\Omega$cm] of a photosensitive layer for the photosensitive drum, a thickness $t_B$ [$\Omega$m] and a volume resistivity $\rho_B$ [$\Omega$cm] for the transfer belt, a thickness $t_P$ [$\mu$m], a volume resistivity $\rho_P$ [$\mu$cm], and a thrust width $\chi$ [cm] for the recording material, and a thrust width y [cm] for the transfer member. It is assumed that a process speed (a moving speed of the transfer belt) is v [cm/s] and a nip width is 1 mm. A peripheral speed of the photosensitive drum is almost the same as the process speed. While the small-sized recording material is set to a single-side reference position for convenience, there is no problem if it is set to a central reference position.

Figure 4:
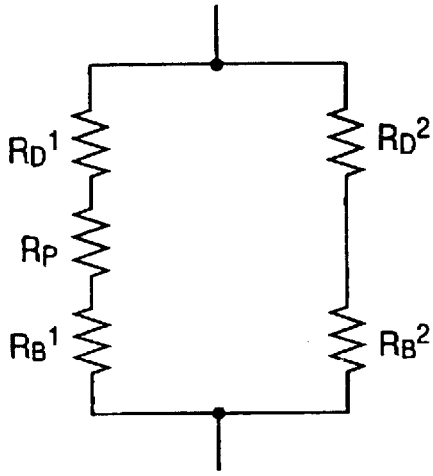
FIG. 4 is a diagram showing an equivalent circuit of the transfer portion in FIG. 3.

An equivalent circuit of the transfer portion in FIG. 3 is as shown in FIG. 4. In FIG. 4, $R_D^1$ indicates a resistance of a portion in contact with the recording material P of the photosensitive drum 3, $R_D^2$ indicates a resistance of a portion directly in contact with the transfer belt 130 of the photosensitive drum 3, $R_P$ indicates a resistance of the recording material P, $R_B^1$ indicates a resistance of a portion in contact with the recording material P of the transfer belt 130, and $R_B^2$ indicates a resistance of a portion directly in contact with the photosensitive drum 3 of the transfer belt 130.

During an image formation, the transfer current flows through paths, $R_D^1 \rightarrow R_P \rightarrow R_B^1$ and $R_D^2 \rightarrow R_B^2$. Electric current flowing through the recording material is obtained by calculating a specific resistance for these paths.

Therefore, each resistance is calculated as follows:

Photosensitive drum:

$$R_D^1=\rho_D\times(t_D\times 10^{-6}\times 10^2)/(0.1\times\chi)=(t_D/\chi)\cdot\rho_D\cdot 10^{-3}\ [\Omega] \quad (1)$$

$$R_D^2=\rho_D\times(t_D\times 10^{-6}\times 10^2)/\{0.1\times(y-\chi)\}=(t_D/(y-\chi)\}\cdot\rho_D\cdot 10^{-3}\ [\Omega] \quad (2)$$

Recording material:

$$R_P=\rho_P\times(t_P\times 10^{-6}\times 10^2)/(0.1\times\chi)=(t_P/\chi)\cdot\rho_P\cdot 10^{-3}\ [\Omega] \quad (3)$$

Transfer belt:

$$R_B^1=\rho_B\times(t_B\times 10^{-6}\times 10^2)/(0.1\times\chi)=(t_B/\chi)\cdot\rho_B\cdot 10^{-3}\ [\Omega] \quad (4)$$

$$R_B^2=\rho_B\times(t_B\times 10^{-6}\times 10^2)/\{0.1\times(y-\chi)\}=(t_B/(y\times\chi)\}\cdot\rho_B\cdot 10^{-3}\ [\Omega] \quad (5)$$

Therefore, a ratio of electric current flowing through respective portions is obtained by the following formula (6) based on a ratio of a resistance of the recording material passing portion to that of the no recording material passing portion:

Current ratio:

$$\text{Recording material passing portion: No recording material passing portion}=1/(R_D^1+R_P+R_B^1):1/(R_D^2+R_B^2) \quad (6)$$

Accordingly, the electric current flowing through the recording material is expressed by the following formula (7) where Itr is transfer current:

$$\text{Current for recording material passing portion}=Itr\times\{1/(R_D^1+R_P+R_B^1)\}/\{1/(R_D^1+R_P+R_B^1)+1/(R_D^2+R_B^2)\}=\{(R_D^2+R_B^2)/(R_D^1+R_D^2+R_B^1+R_B^2+R_P)\}\times Itr[\mu A] \quad (7)$$

Therefore, a surface charge density on the recording material is expressed by the following formula (8):

$$\text{Surface charge density on recording material}=\{(R_D^2+R_B^2)/(R_D^1+R_D^2+R_B^1+R_B^2+R_P)\}\times Itr\{1/(v\cdot\chi)\}[\mu A] \quad (8)$$

Figure 5:
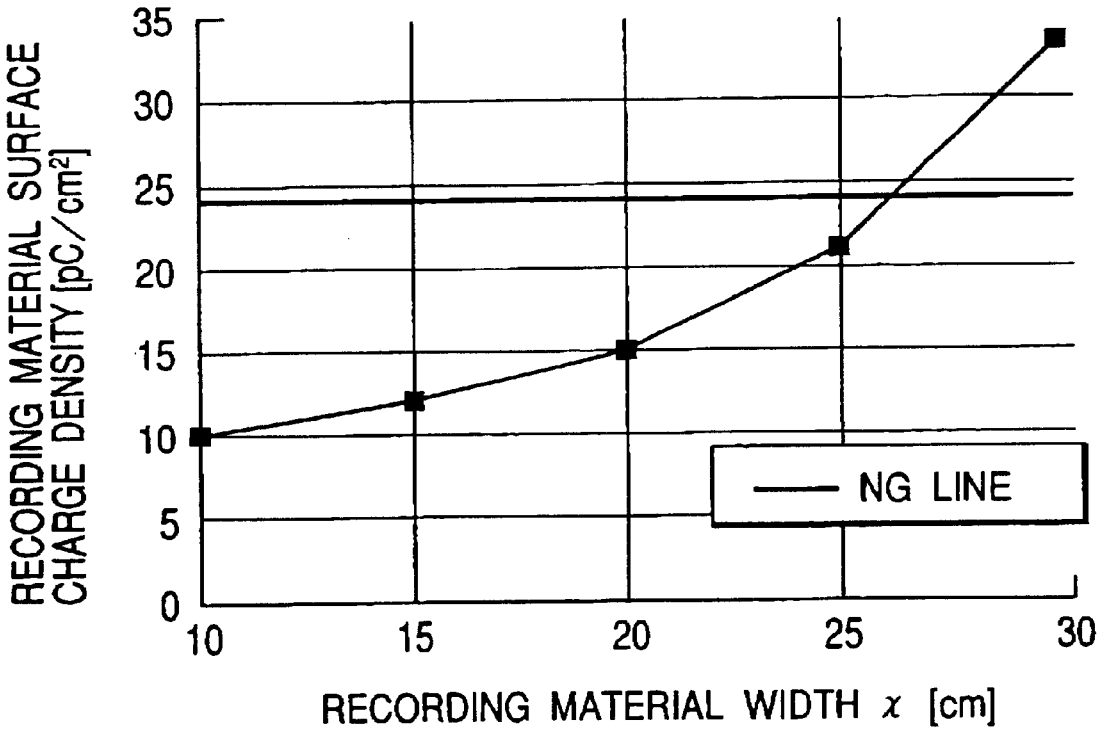
FIG. 5 is a diagram showing a relationship between a surface charge density on a recording material and a recording material width χ.

Referring to FIG. 5, there is shown a diagram indicating how the surface charge density on the recording material changes when a width of the recording material $\chi$ [cm] is varied using the formula (8). Values of other parameters are shown below for reference.

$t_D$=20 [$\mu$m], $\rho_D=10^{14}$ [$\Omega$cm], $t_B$=80 [$\mu$m], $\rho_B=10^{13}$ [$\Omega$cm], $t_P$=100 [$\mu$m], $\rho P=10^{14}$ [$\Omega$cm], y=30 [cm], v=10 [cm/s], Nip width=1 mm From this diagram, if the width $\chi$ of the passed recording material becomes 26.8 cm or lower, the surface charge density on the recording material is 24 pC/cm$^2$ or lower, thus causing poor transferring due to an insufficient density. Therefore, it is impossible to form an image on a sheet having a width of 26.8 cm or lower, in other words, a recording material having a small width such as a postcard or a A4 form of paper fed in a longitudinal direction of the A4 form under these conditions without any poor transferring.

Figure 6:
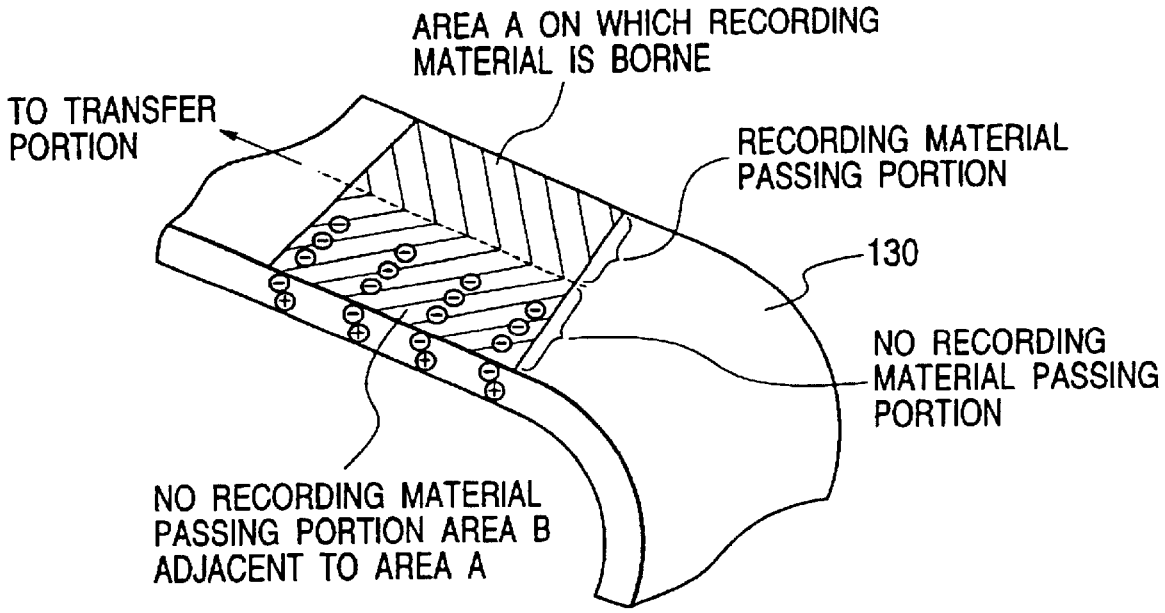
FIG. 6 is an explanatory diagram showing a supply of electric charges having the same polarity as that in a transfer to a no recording material passing portion on a transfer belt performed before the transfer in the present invention.

Accordingly in the present invention, electric charges are previously stored in (supplied to) an area B which is to be a no recording material passing portion adjacent to en area A of the transfer belt on which the recording material is borne before the transfer as shown in FIG. 6, by which an appropriate amount of electric charges are stably supplied to the recording material at the transfer when an image is formed on the recording material having a width smaller than the maximum size, providing a good transfer. It will be described in detail below.

Figure 7:
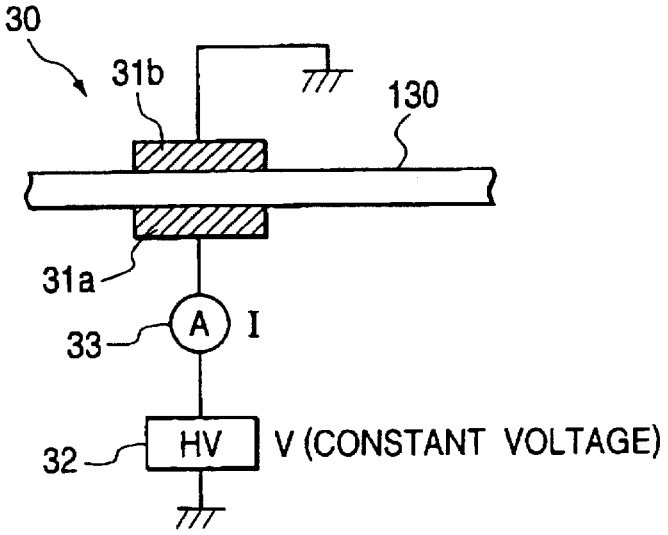
FIG. 7 is a conceptional diagram showing a laboratory charge supplying device used for a supply of electric charges to the no recording material passing portion performed before the transfer in the present invention.
Figure 8:
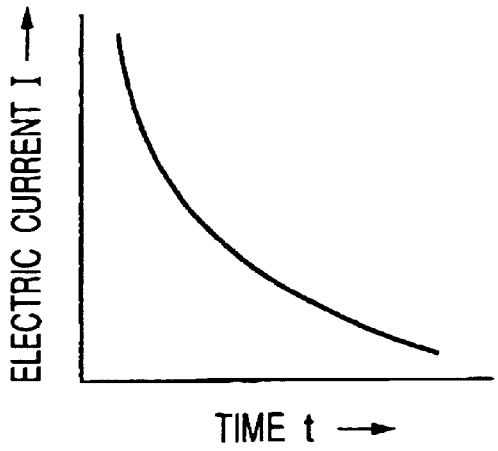
FIG. 8 is a diagram showing a relationship between a time for applying a constant voltage to the transfer belt and its electric current.

Since the transfer belt 130 is made of a dielectric material, if a laboratory electric charge supplying device 30 is used as shown in FIG. 7 to supply electric charges to the no recording material passing portion by applying a voltage from a high-voltage power supply 32 connected to an electrode 31*a* with the no recording material passing portion of the transfer belt 130 put between a pair of electrodes 31*a* and 31*b* of the electric charge supplying device 30, a relationship between polarization current I monitored by an ammeter 33 and applied voltage V is as shown in FIG. 8; more electric charges are stored on both front surface and back surface of the belt 130, an impedance of the belt increases.

Therefore in this embodiment, electric charges are previously stored in the no recording material passing potion of the transfer belt 130 before the transfer when an image is formed on a recording material having a width smaller than that of the maximum-size recording material, so as to prevent poor transferring by utilizing a phenomenon that an impedance is increased in the no recording material passing portion due to an electric charge storage. In this embodiment, a polarity of electric charges stored on the transfer belt 130 is negative (the same polarity as the normal charging polarity of the toner) on the front surface of the belt (on the recording material bearing side) and is positive (opposite polarity to the normal charging polarity of the toner) on the back surface of the belt.

Figure 9:
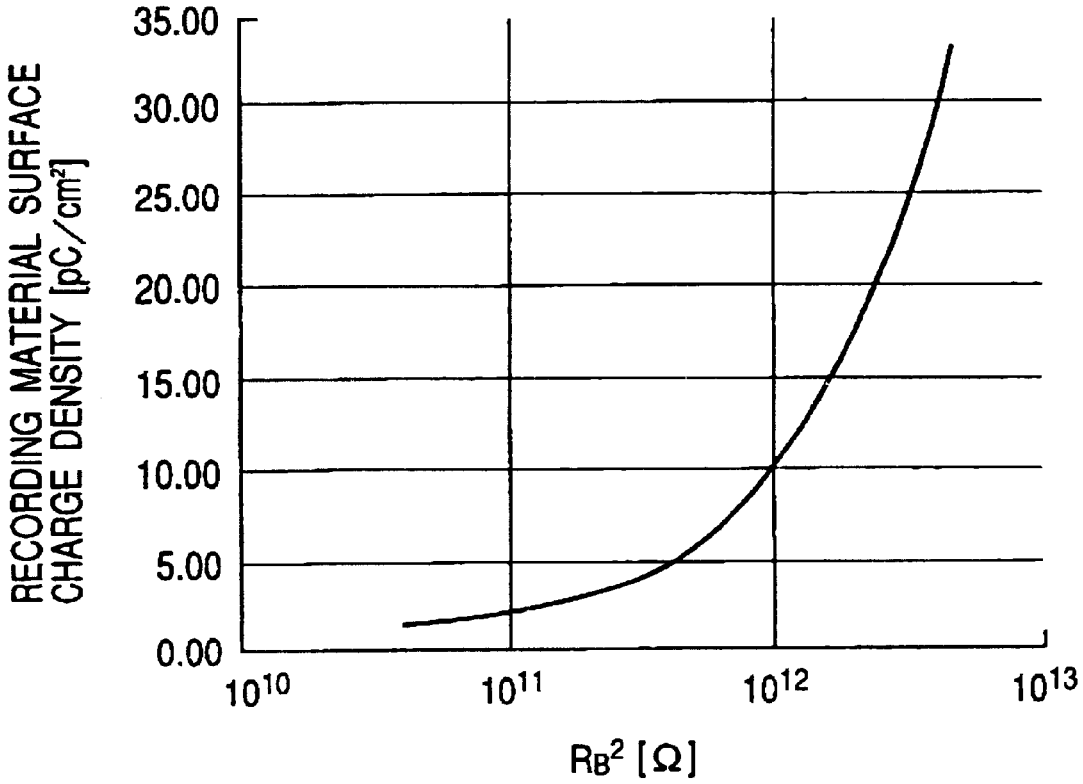
FIG. 9 is a diagram showing a relationship between a resistance $R_B^2$ in a portion of the transfer belt directly in contact with a photosensitive drum and a surface charge density on the recording material.

The above electric charge storage is equivalent to an increase of a value of $R_B^2$ (a resistance of a portion of the transfer belt directly in contact with the photosensitive drum) in the equivalent circuit in FIG. 4. In other words, a resistance ratio of the recording material passing portion to the no recording material passing portion is decreased by increasing $R_B^2$, thereby reducing a difference between electric current per unit area flowing through the recording material passing portion and electric current per unit area flowing through the no recording material passing portion. Therefore as shown in FIG. 9, as $R_B^2$ is increased, the surface charge density on the recording material is increased, thus decreasing poor transferring as described above.

Figure 10:
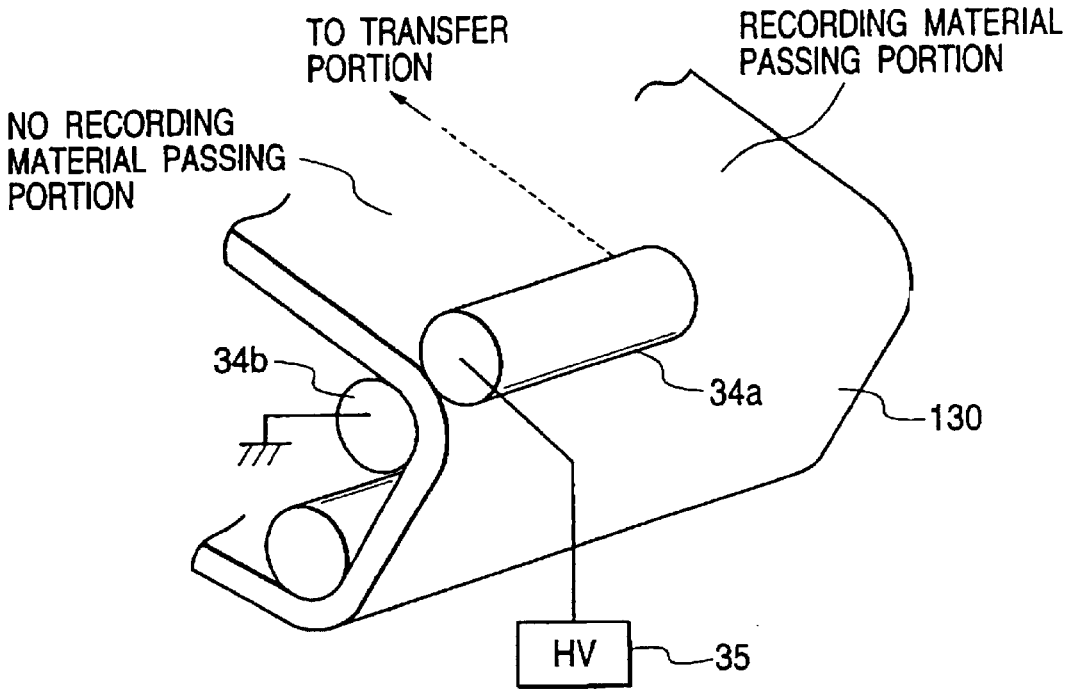
FIG. 10 is an explanatory diagram showing a charge supplying method to the no recording material passing portion before a transfer in an embodiment of the present invention.

To supply previously electric charges having the same polarity as a polarity in a transfer to the back surface of the no recording material passing portion of the transfer belt 130 before the transfer, for example as shown in FIG. 10, there may be two rollers 34*a* and 34*b* between which the no recording material passing portion of the transfer belt 130 is interposed with the lower roller 34*b* being grounded and the upper roller 34*a* to which a voltage having the same polarity as the normal charging polarity of the toner is applied from a high-voltage power supply 35.

Figure 11:
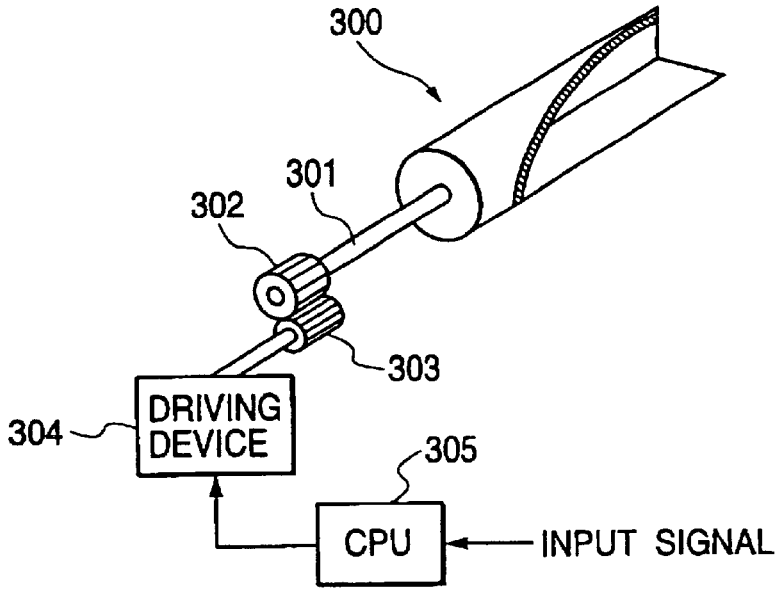
FIG. 11 is a perspective view showing a preferable modification of a roller used for supplying electric charges according to the present invention.
Figure 12:
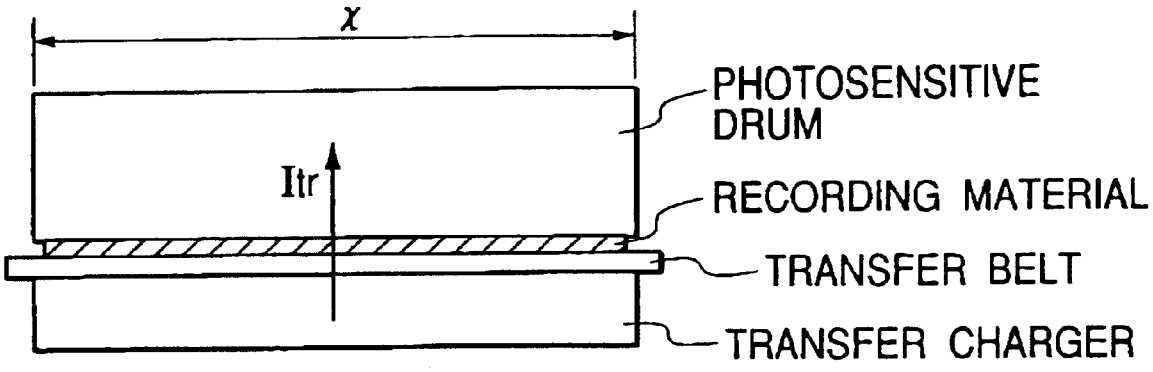
FIG. 12 is a sectional view showing a transfer portion of the image forming apparatus in FIG. 1.
Figure 13:
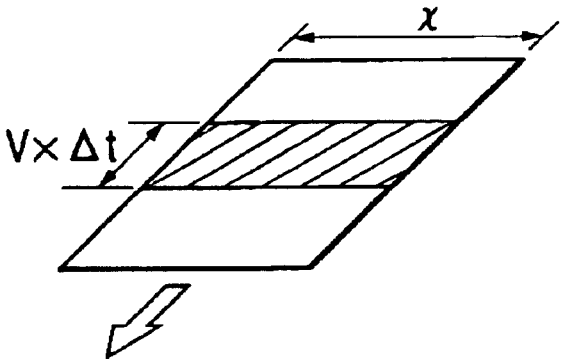
FIG. 13 is a perspective view showing a target area of a recording material in a transfer in Δt sec in the transfer portion in FIG. 12.
Figure 14:
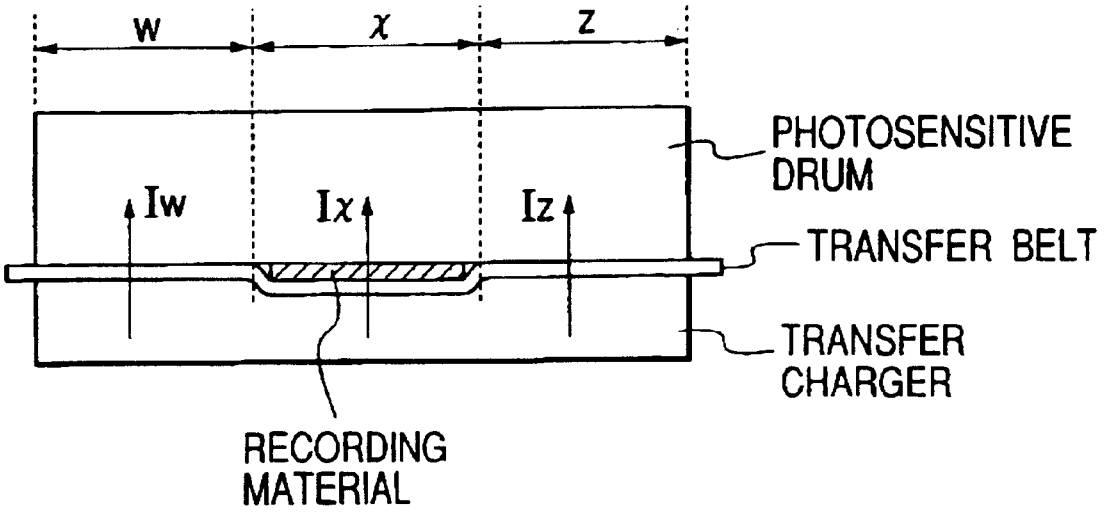
FIG. 14 is a sectional view showing a transfer portion on transferring to a small-sized recording material.
Figure 15:
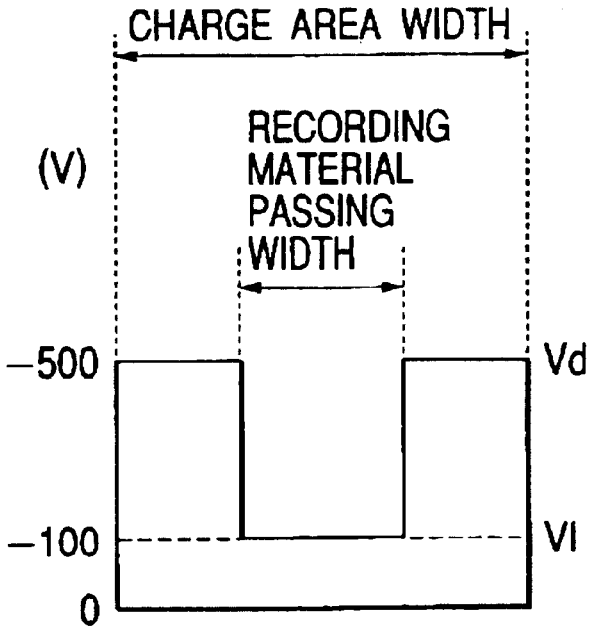
FIG. 15 is a diagram showing a surface potential of a photosensitive drum.

It is possible to use a roller 300 as shown in FIG. 11 as the upper roller 34*a* so that the electric charge supply to the transfer belt 130 can be applied to recording materials having various widths. A conductive cylinder of the roller 300 is cut out in such a way that a cutout amount is increased in the thrust direction, so that a length in the thrust direction of the roller 300 continuously varies in a peripheral direction.

This roller 300 is enabled to rotate in the peripheral direction with an engagement of its central shaft 301 rotatably with an attachment portion which is not shown. This roller 300 is rotated by a forward and reverse rotatable motor of a driving device 304 via a gear 302 attached to an end of the central shaft 301 and a gear 303 on a side of the driving device 304 engaging with the gear 302. Its rotation amount is controlled by a CPU 305 as control means.

In a manual recording material feeding portion or a cassette recording material feeding portion, a recording material width of the recording material P is always detected, the recording material width information is received by the CPU 305, the CPU 305 controls a rotation angle of the motor of the driving device 304 based on the recording material width information, by which the motor of the driving device 304 rotates to rotate the roller 300 by a predetermined angle, so that a peripheral surface of the roller 300 having a length matched to a width of the no recording material passing portion of the transfer belt 130 is directed to the transfer belt 130 to abut against the no recording material passing portion.

This roller 300 abuts against the transfer belt 130 only in forming an image on a small-sized recording material and therefore it is preferable to put it spaced from the transfer belt in other conditions.

Desirably electric charges previously stored on the transfer belt 130 do not disappear until the transfer belt reaches a residual charge eliminating process, and therefore it is preferable to select materials having a long charging relaxation time. Accordingly, a material having a high volume resistivity value, specifically $1.0\times10^3$ to $1.0\times10^{17}$ Ωcm, is preferable.

While the lower roller 34*b* shown in FIG. 10 is grounded and a negative voltage is applied to the upper roller 34*a* or the roller 300 in FIG. 11 in this embodiment, to the contrary, there is no problem if a positive voltage is applied to the upper roller 34*a* and the roller 300, and the lower roller 34*b* is grounded.

As for detecting a width of a recording material (length $\chi$ in the thrust direction), a mechanical sensor or an optical sensor may be used for an automatic discrimination or an operator may enter the width of the recording material from an operating unit or the like instead of the detecting operation.

In addition, while a transfer belt is shown as a recording material bearing member, a transfer drum may be used therefor. Furthermore, as described in a third embodiment with an application of the present invention, the invention makes it possible to prevent the poor transferring from occurring in the primary transfer portion and the secondary transfer portion of the intermediate transfer member. The image bearing member is not limited to an electrophotographic photosensitive member such as a photosensitive drum, but may be a dielectric member in electrostatic recording.

As a developing unit (1*a* to 1*d*), any type of a developing method may be used.

In general, developing methods are mainly classified into a mono-component development and a two-component development; there are two types of mono-component development methods such as a mono-component non-contacting development method in which toner is not put in contact with the image bearing member during development and a mono-component contacting development method in which toner is put in contact with the image bearing member during development, each after coating a development sleeve with non-magnetic toner by using a blade or the like or coating the development sleeve with magnetic toner by a magnetic force and then conveying the toner to a development portion opposite to the image bearing member with a rotation of the development sleeve, and there are two types of two-component development methods such as a two-component non-contacting development method in which developer is not put in contact with the image bearing member during development and a two-component contacting development method in which developer is put in contact with the image bearing member during development, each after coating the development sleeve with two-component developer made of toner particles mixed with magnetic carriers by a magnetic force and then conveying the two-component developer to the developing portion by the development sleeve. The two-component contacting development method is frequently used from a viewpoint of high quality and high stability of images.

While the value of the required surface charge density on a recording material is shown to be 24 pC/cm$^2$ in this embodiment, the required surface charge density on a recording material depends upon, for example, a triboelectrification charge amount (triboelectricity) of toner, a type of toner, or an installation environment of an image forming apparatus, and therefore it is not limited to the above.

In addition, while an area to be charged before the transfer is only the no recording material passing portion of the transfer belt 130 in this embodiment, the charge area before the transfer is not limited to this if poor transferring does not occur after charging as described above. In this case, an amount of electric charges supplied to the no recording material passing portion should be greater than that of electric charges to the recording material passing portion.

According to the present invention, the image forming apparatus may be a transfer drum type in which toner images are sequentially formed on a photosensitive member and then sequentially transferred to a recording material borne by a transfer drum. In this case, desired charging is performed for an area of the no recording material passing portion of a transfer sheet composing the transfer drum.

Even in an intermediate transfer process in which toner images are sequentially formed on one or more photosensitive drums and the toner images are primarily transferred onto an intermediate transfer member sequentially and then secondarily transferred to a recording material collectively, the present invention is applicable if the above recording material bearing member is used for conveying the recording material to a secondary transfer portion.

The present invention is applicable also when a constant voltage power supply is connected to a transfer charger to control a voltage applied to the transfer charger at a constant voltage.

In addition, the present invention is applicable to an image forming apparatus (for example, a black-and-white (monochrome) image forming apparatus) in which a single photosensitive drum is arranged and a toner image (for example, a black toner image) on the photosensitive drum is transferred to a recording material borne by a transfer belt to be conveyed.

Second Embodiment

A constitution of this embodiment is the same as for the first embodiment, except that a charge amount by which a transfer belt 130 is previously charged before a transfer is controlled according to a type of a recording material and/or a humidity (and a temperature) in an apparatus.

There is a difference in electric current flowing through a no recording material passing portion in a transfer under the same environment (temperature and humidity) between a condition in use of a transparent resin sheet for an overhead projector (OHT) as a recording material and a condition in use of a plain paper, by which poor transferring sometimes occurs when is used a recording material (OHT) having a relatively high volume resistivity.

Therefore, in this embodiment, a voltage applied to a roller 34*a* is controlled by a CPU as control means according to a type of the recording material, by which the above poor transferring has been successfully prevented. Specifically, a voltage applied to the roller 34*a* in use of the OHT as a recording material is increased to be greater than that in use of the plain paper as a recording material, in order to increase a charge amount on the no recording material passing portion of the transfer belt 130.

Furthermore, even if a similar type of a recording material is used, poor transferring sometimes occurs since a volume resistivity of the recording material becomes relatively high depending on an environment (remarkable in a low humidity environment).

Therefore in this embodiment, a voltage applied to the roller 34*a* is controlled by the CPU according to a humidity (and a temperature) in the apparatus in addition to the control according to the type of the recording material, by which the above poor transferring has been successfully prevented.

Figures 16A, 16B, 16C:
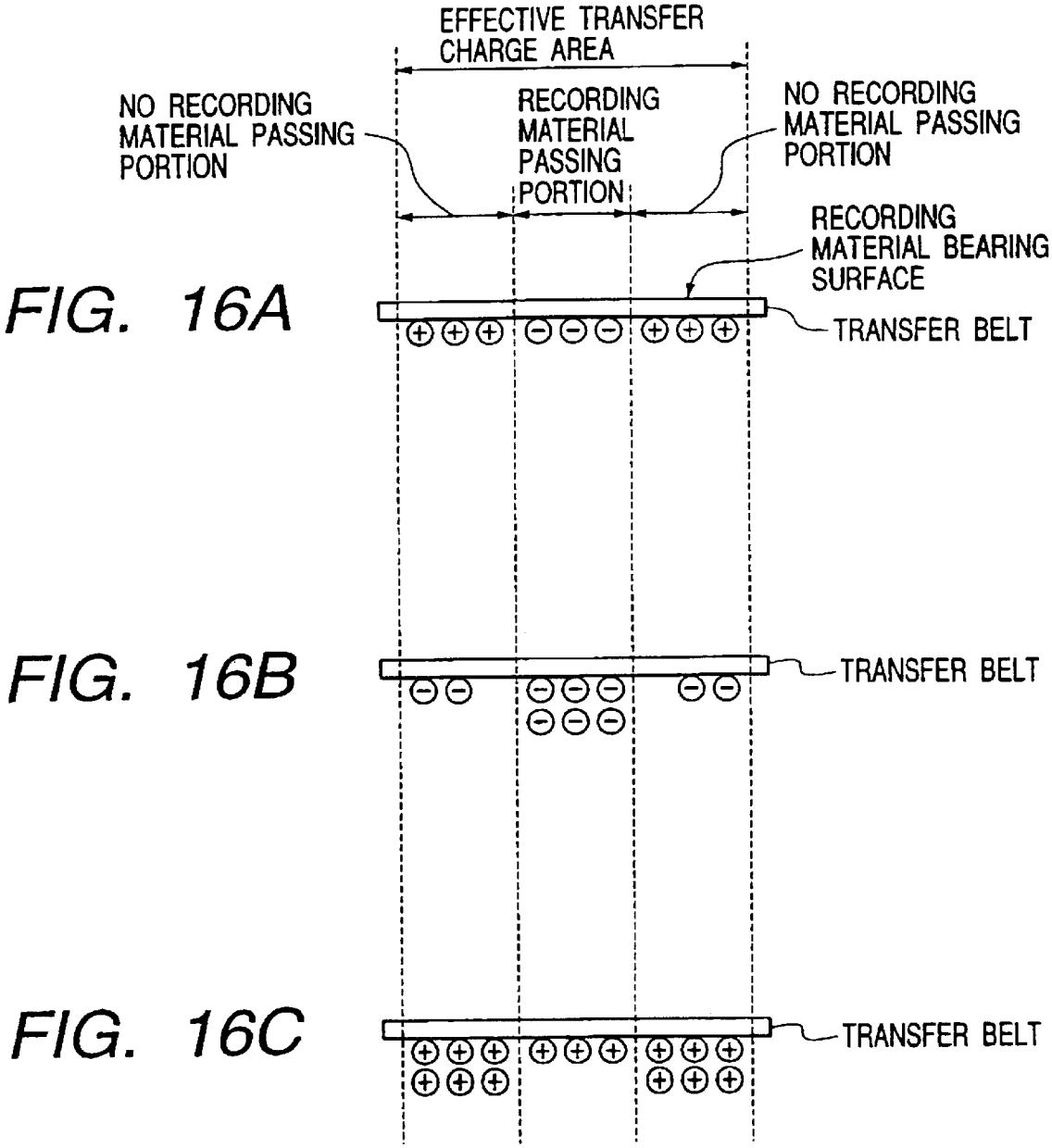
FIGS. 16A, 16B, and 16C are diagrams showing modifications of the present invention.

While positive electric charges are supplied only to the no recording material passing portion of the transfer belt before the recording material is borne by the transfer belt in the first and second embodiments set forth in the above, it is not limited to this. For example, the transfer belt may be charged as shown in FIGS. 16A, 16B, and 16C to prevent an occurrence of poor transferring. Also in FIGS. 16A to 16C, a polarity of a voltage applied to the transfer charger is positive, that is, a polarity of electric charges supplied to the transfer belt by the transfer charger is positive. In other words, an amount of electric charges supplied to the no recording material passing portion should be greater than that of electric charges supplied to the recording material passing portion in a positive direction (a polarity of electric charges supplied by the transfer charger).

Describing a method of obtaining a charge amount distribution on the transfer belt, a surface electrostatic voltmeter (EFS-22D, EFS-31D) manufactured by TDK Corp. is used to measure a potential V of the transfer belt at respective points in the thrust direction and then a charge amount Q of each point is obtained based on a known electrostatic capacity C of the transfer belt.

Third Embodiment

Next, a description will be made for an embodiment in which the present invention is applied to an image forming apparatus using an intermediate transfer member.

There is known a method in which a toner image is formed on a photosensitive drum as an image bearing member, transferring the toner image first on an intermediate transfer member (a primary transfer) is repeated to superpose toner images of a plurality of colors on the intermediate transfer member, and then the toner images of the plurality of colors are transferred collectively onto a recording material such as paper (a secondary transfer).

Figure 17:
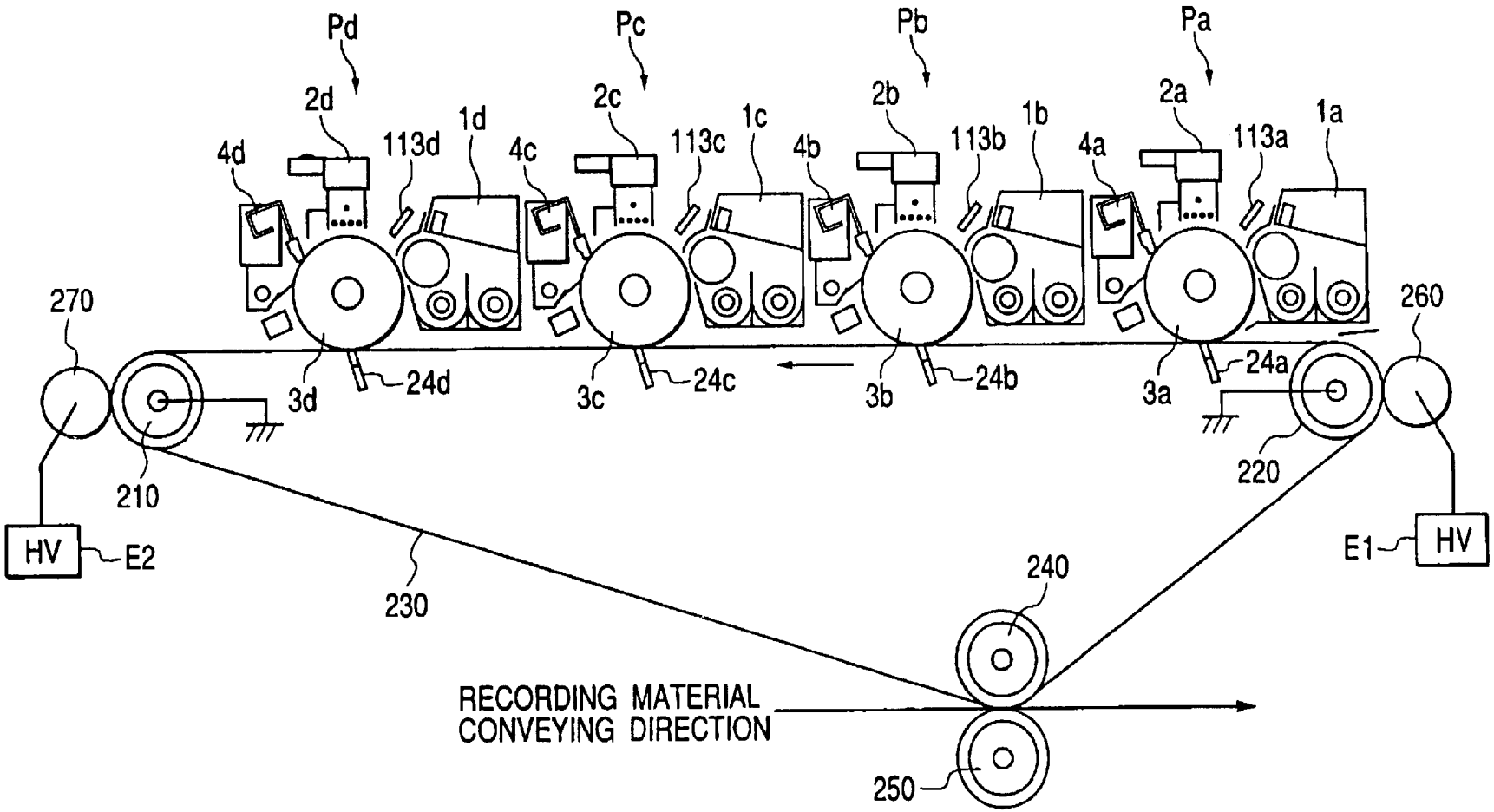
FIG. 17 is a schematic constitutional diagram showing an embodiment of an image forming apparatus of the present invention.
Figure 23:
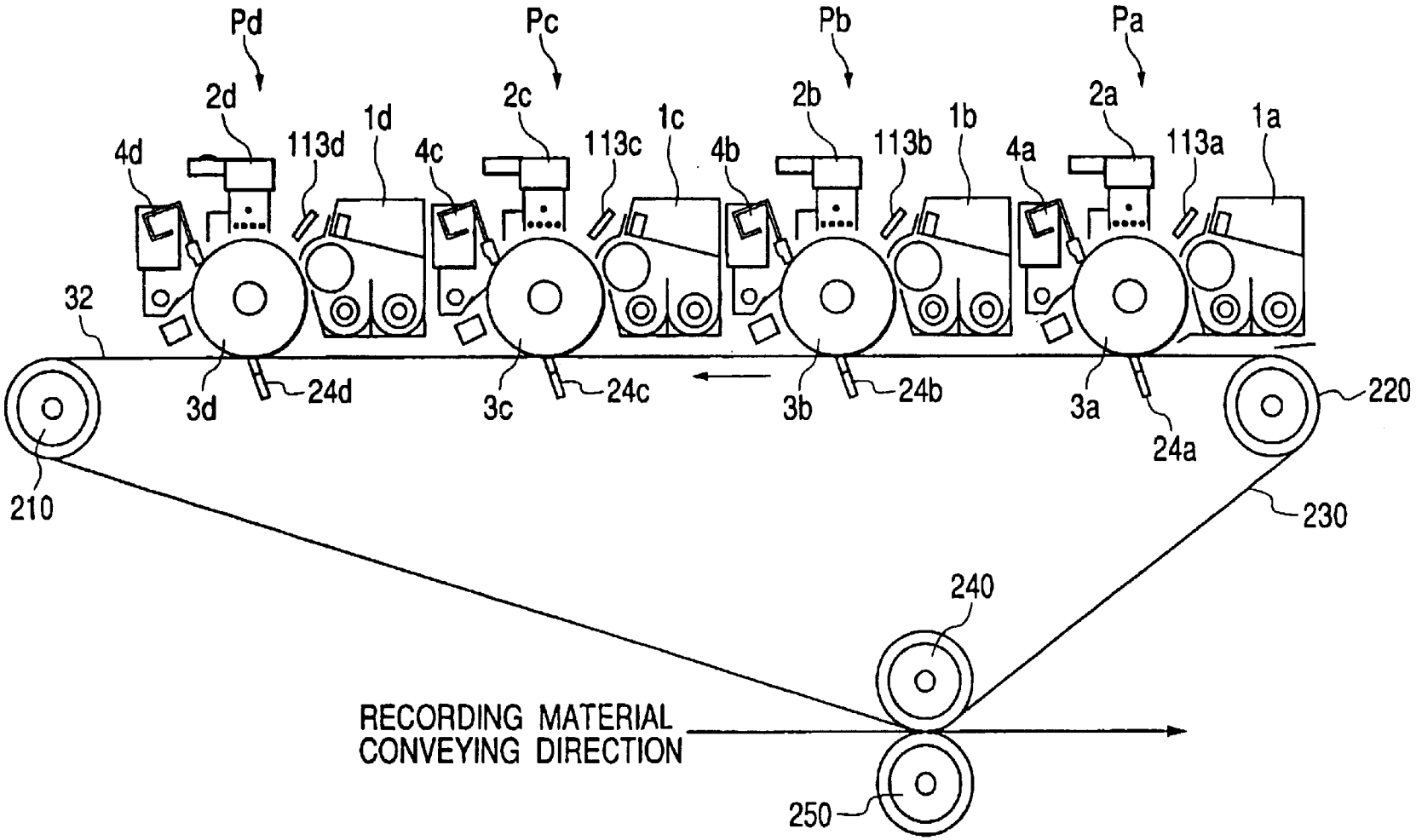
FIG. 23 is a schematic diagram showing a conventional image forming apparatus.
Figure 24:
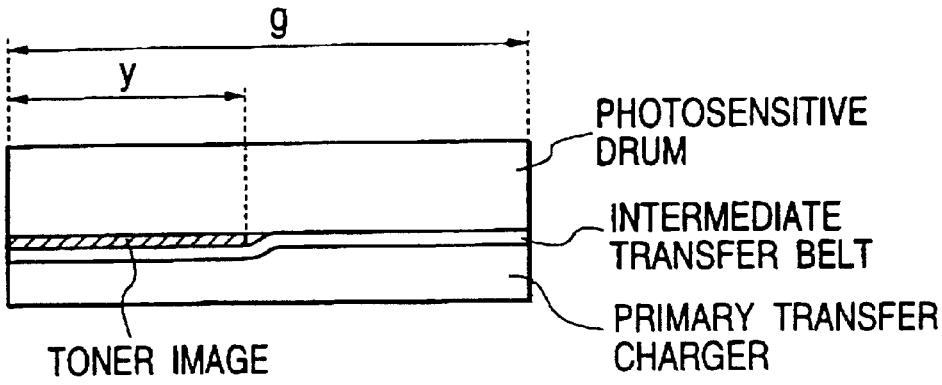
FIG. 24 is a sectional view showing a primary transfer portion in the image forming apparatus in FIG. 23.
Figure 25:
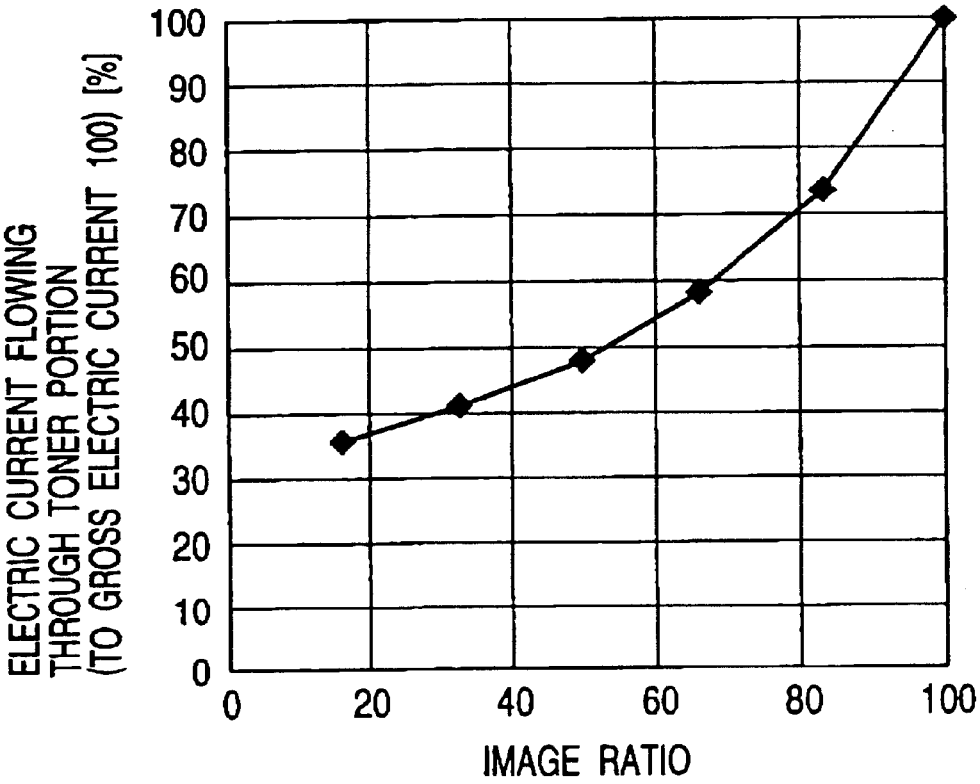
FIG. 25 is a diagram showing a relationship between an image ratio in the primary transfer and transfer current flowing through an image portion.
Figure 26:
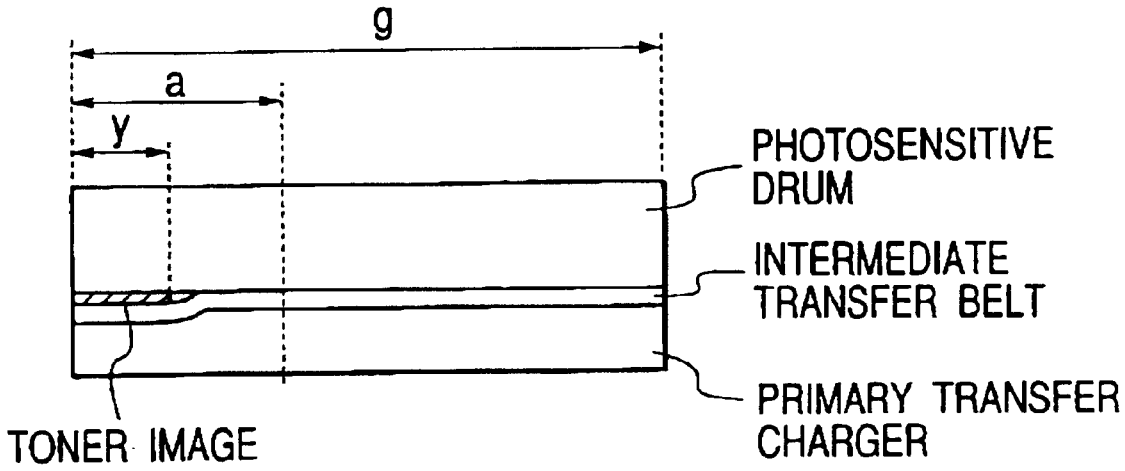
FIG. 26 is a sectional view showing the primary transfer portion on transferring to a small-sized recording material.
Figure 27:
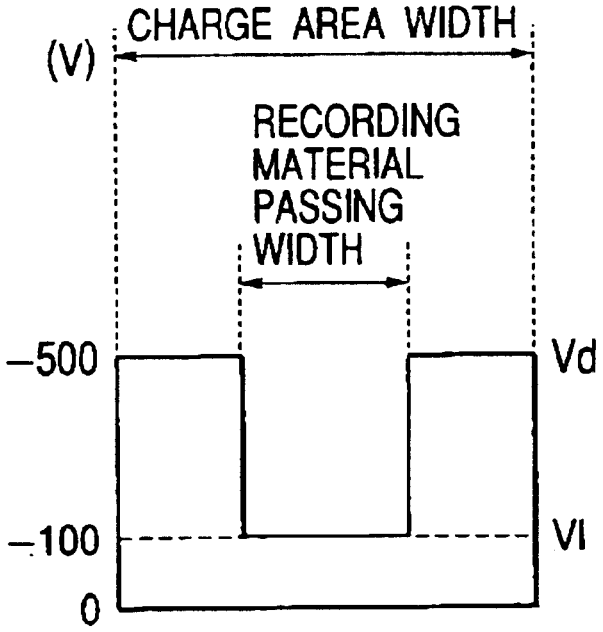
FIG. 27 is a diagram showing a surface potential of a photosensitive drum.
Figure 28:
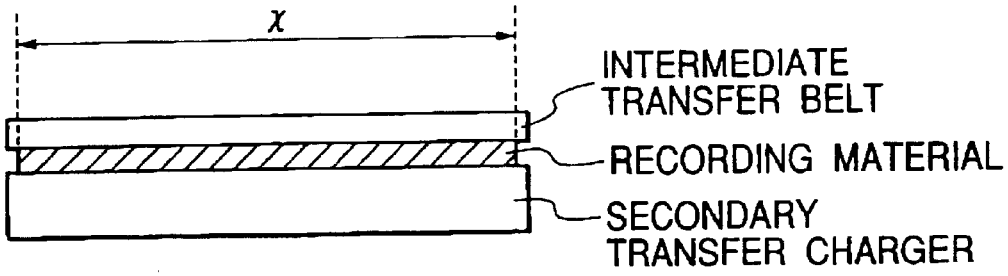
FIG. 28 is a sectional view showing a secondary transfer portion.
Figure 29:
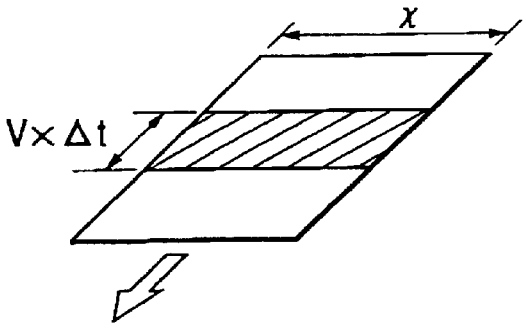
FIG. 29 is a perspective view showing a target area of a recording material in a transfer in $\Delta t$ sec in the transfer portion in FIG. 28.
Figure 30:
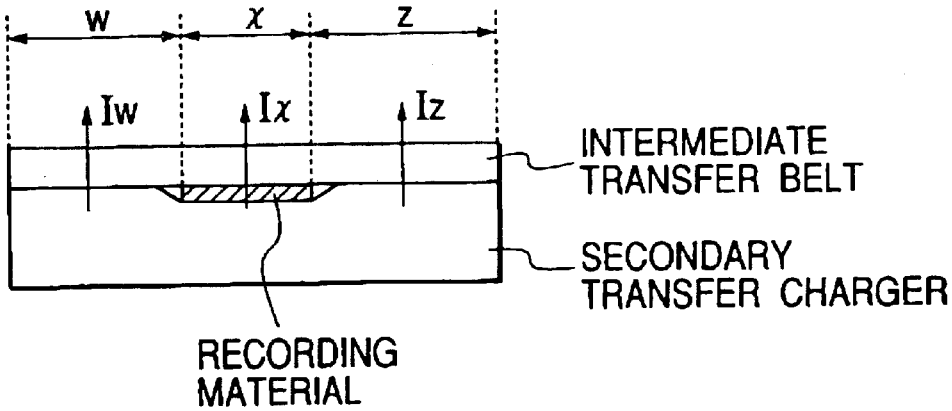
FIG. 30 is a diagram showing a state of electric current flowing between an intermediate transfer belt and secondary transfer means in the secondary transfer of the small-sized recording material.

FIGS. 17 and 23 show examples of an image forming apparatus using an intermediate transfer member. The same reference characters designate corresponding parts having the same functions as those in the first embodiment.

As shown in FIGS. 17 and 23, first, second, third, and fourth image forming portions Pa, Pb, Pc, and Pd are arranged in a line in the apparatus, and toner images of a plurality of colors are formed on the intermediate transfer member through latent image formation, development, and primary transfer processes in respective image forming portions Pa to Pd.

The image forming portions Pa, Pb, Pc, and Pd include dedicated image bearing members, electrophotographic photosensitive drums 3*a*, 3*b*, 3*c*, and 3*d*, respectively in this embodiment, and respective toner images are formed on the photosensitive drums 3*a*, 3*b*, 3*c*, and 3*d*. An intermediate transfer belt 230 as an intermediate transfer member is arranged with being adjacent to the photosensitive drums 3*a*, 3*b*, 3*c*, and 3*d* and this intermediate transfer belt 230 is extended around a driving roller 210, a supporting roller 220, and a back roller 240 and rotated in a direction indicated by an arrow with being driven by a driving roller 210. The toner images of the respective colors formed on the photosensitive drums 3*a*, 3*b*, 3*c*, and 3*d* are superposed on top of one another on an intermediate transfer belt 230 for a primary transfer so as to form toner images of the four colors superposed on the intermediate transfer belt 230.

Subsequently the toner images of the four colors on the intermediate transfer belt 230 are secondarily transferred collectively to a recording material P conveyed with being nipped between a secondary transfer roller 250 and the intermediate transfer belt 230. The recording material P to which the toner images of the respective colors have been transferred is subjected to fixing of the toner images by a fixing device 9 with heating and pressurizing and then discharged to an outside of the apparatus as a color recording image.

In outer peripheral portions of the photosensitive drums 3*a*, 3*b*, 3*c*, and 3*d*, there are provided drum chargers 2*a*, 2*b*, 2*c*, and 2*d*, electrostatic voltmeters 113*a*, 113*b*, 113*c*, and 113*d*, developing units 1*a*, 1*b*, 1*c*, and 1*d*, transfer chargers 24*a*, 24*b*, 24*c*, and 24*d*, and cleaners 4*a*, 4*b*, 4*c*, and 4*d*. Further in upper portions of the apparatus, there are provided a light source unit which is not shown and a polygon mirror.

A laser beam generated from the light source unit is rotated by the polygon mirror for scanning and a luminous flux of the scanning light is deflected by a reflecting mirror and then condensed in generatrix directions of the photosensitive drums 3*a*, 3*b*, 3*c*, and 3*d* by an fθ lens for an exposure, by which electrostatic latent images are formed on the photosensitive drums 3*a*, 3*b*, 3*c*, and 3*d* according to image signals.

The developing units 1*a*, 1*b*, 1*c*, and 1*d* are filled with a predetermined amount of cyan, magenta, yellow, and black toner as developer, respectively, each having a negative polarity as a normal charging polarity, being supplied by supplying devices which are not shown. The developing units 1*a*, 1*b*, 1*c*, and 1*d* are used to develop latent images on respective photosensitive drums 3*a*, 3*b*, 3*c*, and 3*d* so as to visualize them as a cyan toner image, a magenta toner image, a yellow toner image, and a black toner image.

The recording material P is contained in a recording material cassette which is not shown. The recording material P is then supplied onto a secondary transfer portion of the intermediate transfer belt 230 through a plurality of conveying rollers and a registration roller.

The intermediate transfer belt 230 is made of a sheet of dielectric resin such as polyvinilidene fluoride (PVdF), nylon, polyethylene terephthalate (PET), or polyurethane resin, each having a volume resistivity of approx. $10^{11}$ to $10^{16}$ Ωcm in an endless configuration with its both ends superposed on each other being bonded or in a seamless belt configuration.

If this intermediate transfer belt 230 is confirmed to be in a predetermined position after being rotated by the driving roller 210, an image is formed on the photosensitive drum 3*a* of the first image forming portion Pa at a certain timing. Then by applying a voltage having an opposite polarity to the normal charging polarity of the toner to the transfer charger 24*a* in the transfer portion in the lower side of the photosensitive drum 3*a*, the color toner image of the first color formed on the photosensitive drum 3*a* is primarily transferred to the intermediate transfer belt 230.

As the transfer charger 24 (24*a* to 24*d*), there can be used a non-contacting charger such as a corona-discharge type or contacting charger with a transfer member such as a conductive blade, roller, or brush. The non-contacting charger has problems that it generates ozone and that it is susceptible to changes in an atmospheric temperature and humidity environment due to charging through an air by which an image cannot be formed stably. There are no such problems in the contacting charger, having such merits that it is ozoneless, resistant to changes in an atmospheric temperature and humidity environment, and useful to obtain high image qualities. In this embodiment, a contacting charger is applied to the transfer charger 24.

Image formation and transfer processing are performed in the same manner as for the first image forming portion Pa also in the second to fourth image forming portions Pb to Pd. Subsequently the intermediate transfer belt 230 to which the toner image having four colors has been transferred is submitted to a secondary transfer of the toner image to a recording material with secondary transfer means comprising the secondary transfer roller 250 and the back roller 240.

The secondary transfer is performed with arranging a back roller 240 having a low resistance as an opposite electrode with being grounded or with an appropriate bias applied inside the intermediate transfer belt 230, forming a secondary transfer nip with the intermediate transfer belt 230 put between the back roller and a secondary transfer roller 250 having a low resistance arranged outside, applying a voltage of an opposite polarity to the normal charging polarity of the toner (positive polarity) to the secondary transfer roller 250, and then making the secondary transfer roller 250 abut against the back surface of the recording material P.

The recording material P after the secondary transfer is conveyed to the fixing device which is not shown through an appropriate conveying path. The fixing device comprises a fixing roller, a pressure roller, a heat-resistant cleaning member for cleaning each thereof, heaters installed in the fixing roller and the pressure roller, a coating roller for coating the fixing roller with molding lubricant oil such as demethyl silicone oil, its oil reservoir, and a thermistor for controlling a fixing temperature with detecting a temperature of a surface of the pressure roller.

For the recording material P to which the four-color toner image has been secondarily transferred, the colors of the toner image are mixed and fixed to the recording material P by a fixing process, by which a full-color copy image is formed and the recording material P is discharged to a discharge tray.

The photosensitive drums 3*a*, 3*b*, 3*c*, and 3*d* having completed the transfer are continuously prepared for the subsequent latent image formation and its following processes after their transfer residual toner is cleaned to be removed by respective cleaners 4*a*, 4*b*, 4*c*, and 4*d*. Residual toner and other contaminants on the intermediate transfer belt 230 are scraped off by making a cleaning web (nonwoven fabric) which is not shown abut against a surface of the intermediate transfer belt 230.

The intermediate transfer belt 230 used for the image forming apparatus having the above constitution is a dielectric sheet such as a PET sheet, a polyvinilidene fluoride resin sheet, or a polyurethane sheet as described above and its volume resistivity is generally within a range of $10^{13}$ to $10^{18}$ Ωcm.

As for the secondary transfer, it is preferable to control constant current by a constant current power supply so as to obtain constant current even if a volume resistivity of a recording material changes due to a type of the recording material (a thickness, a quality of material, etc.) or hygroscopic conditions; this embodiment requires a transfer voltage of several kV. Also for the primary transfer, it is preferable to perform a constant current control.

As an intermediate transfer member, an intermediate transfer drum (roller) may be used instead of the above intermediate transfer belt 230. The intermediate transfer belt is superior to the intermediate transfer drum in respects of a degree of freedom in arrangement and a separability (curvature separation is possible) of a recording material after the secondary transfer.

As a dielectric sheet material for the intermediate transfer belt 230, it is also possible to use a film sheet of engineering plastic as well as the above material, such as PET, polyacetal, polyamide, polyvinyl alcohol, polyether ketone, polystyrene, polybutylene terephtalate, polymethylpentene, polypropylene, polyethylene, polphenylene sulfide, polyurethane, silicone resin, polyamide-imide, polycarbonate, polyphenylene oxide, polyether sulfone, polysulfone, aromatic polyester, polyether imide, or aromatic polyimide.

In this embodiment, a polyimide resin is used as a material of the intermediate transfer belt 230 from a viewpoint of mechanical characteristics, electrical characteristics, and incombustibility. It is seamless-typed having a volume resistivity of $10^{16}$ Ωcm and a thickness of 100 μm. Its process speed (a moving speed of the intermediate transfer belt) is 100 mm/sec.

A primary transfer charger, in other words, the contacting transfer charger 24 (24*a* to 24*d*) has a transfer member of a plate-shaped conductive rubber (blade) extending in a direction (in a thrust direction) perpendicular to a driving direction of the intermediate transfer belt 230 and this transfer member is pushed to the photosensitive drum 3 (3*a* to 3*d*) via the intermediate transfer belt 230. This transfer charger 24 charges a back surface of the intermediate transfer belt 230 with an opposite polarity (plus in this embodiment) to a polarity of toner and a toner image on the photosensitive drum 3 is electrostatically transferred to a surface of the recording material P. In this embodiment, the primary transfer is performed with a constant current control by using 10 μA of transfer current.

A secondary transfer charger, in other words, the contacting secondary transfer roller 250 comprises a conductive roller extending in a direction perpendicular to a recording material conveying direction. The secondary transfer roller 250 and the back roller 240 form a secondary transfer nip with the intermediate transfer belt 230 and the recording material P put between the secondary transfer roller 250 and the back roller 240, and the secondary transfer roller 250 is charged with an opposite polarity (plus in this embodiment) to a polarity of toner, by which a toner image on the intermediate transfer belt 230 is electrostatically transferred to a surface of the recording material P. In this embodiment, the secondary transfer is performed with a constant current control by using 20 μA of transfer current.

Also in this embodiment in the same manner as for the first and second embodiments, electric charges having the same polarity as the polarity of toner are previously stored before the primary transfer in an area which is to be a no recording material passing portion on the intermediate transfer belt 230 when an image is formed on a recording material having a width smaller than that of the maximum size recording material, thereby reducing a decrease of transfer current in an image portion in the primary transfer, and furthermore electric charges opposite to the above are stored in the no recording material passing portion before the secondary transfer, thereby resolving an insufficiency of a surface charge density on the recording material in the secondary transfer. It will be described in detail below.

Figure 18:
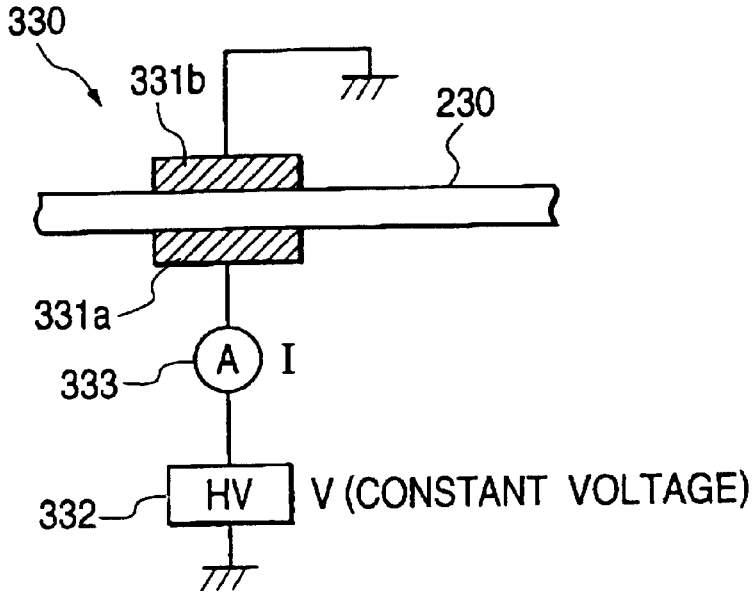
FIG. 18 is a conceptional diagram showing a laboratory charge supplying device used for a supply of electric charges to a no recording material passing portion performed before a transfer in the present invention.
Figure 19:
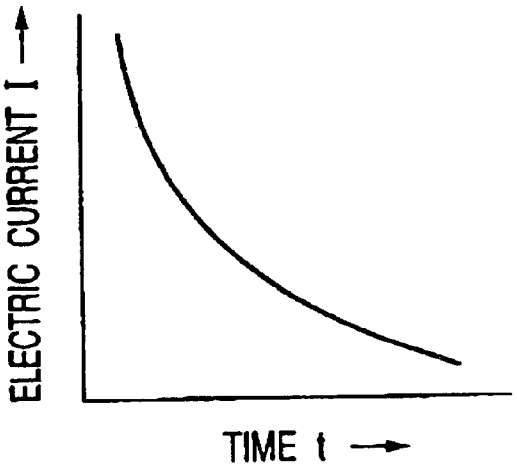
FIG. 19 is a diagram showing a relationship between a time for applying a constant voltage to a transfer belt and its electric current.

Since the intermediate transfer belt 230 is made of a dielectric material, if a laboratory electric charge supplying device 330 is used as shown in FIG. 18 to supply electric charges to the no recording material passing portion by applying a voltage from a high-voltage power supply 332 connected to an electrode 331*a* with the no recording material passing portion of the intermediate transfer belt 230 put between a pair of electrodes 331*a* and 331*b* of the electric charge supplying device 330, a relationship between polarization current I monitored by an ammeter 333 and applied voltage V is as shown in FIG. 19; more electric charges are stored on both front and back surfaces of the intermediate transfer belt 230, an impedance of the belt increases.

Figure 20:
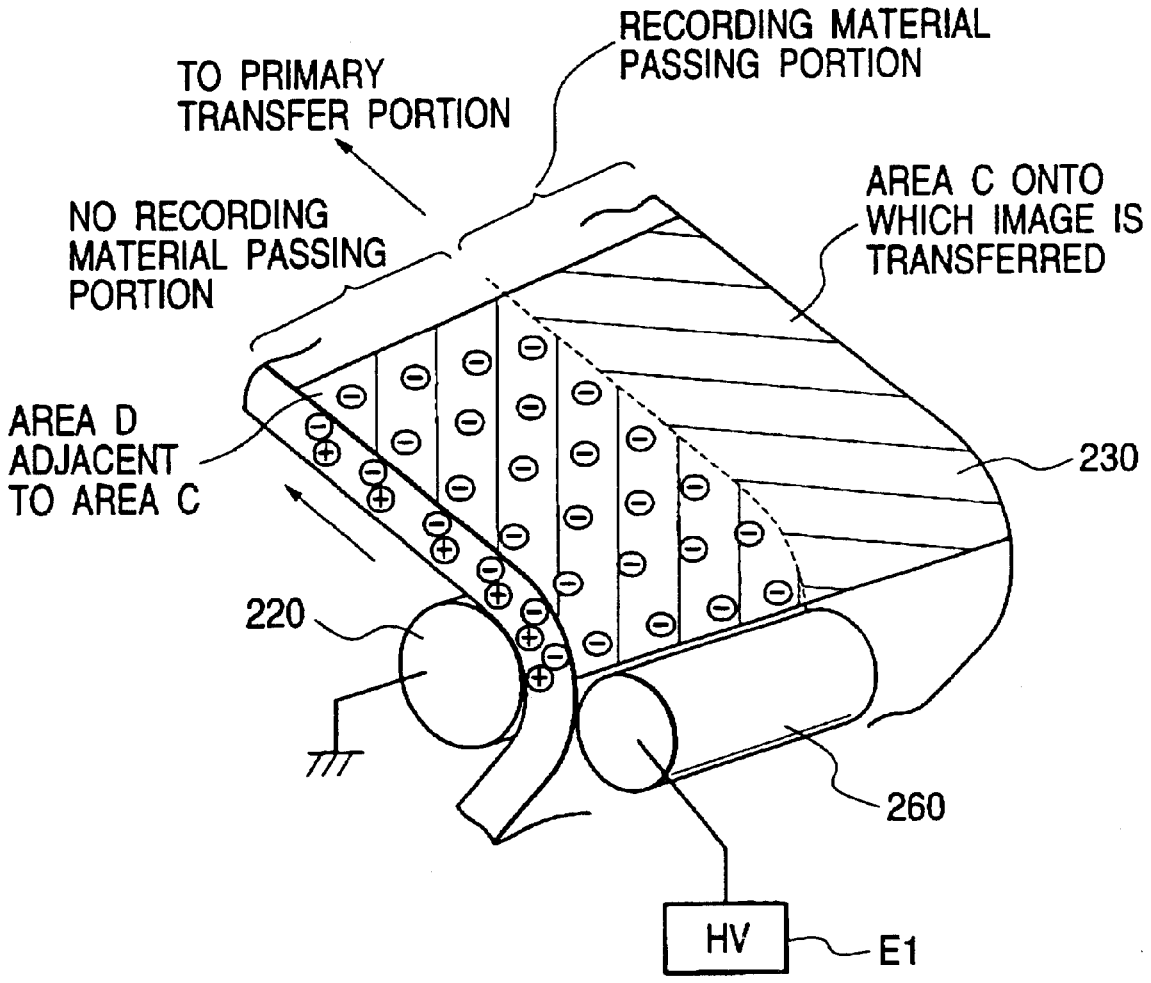
FIG. 20 is an explanatory diagram showing a supply of electric charges having the same polarity as that in a primary transfer to a no recording material passing portion on a transfer belt performed before the primary transfer in the present invention.
Figures 31A, 31B, 31C:
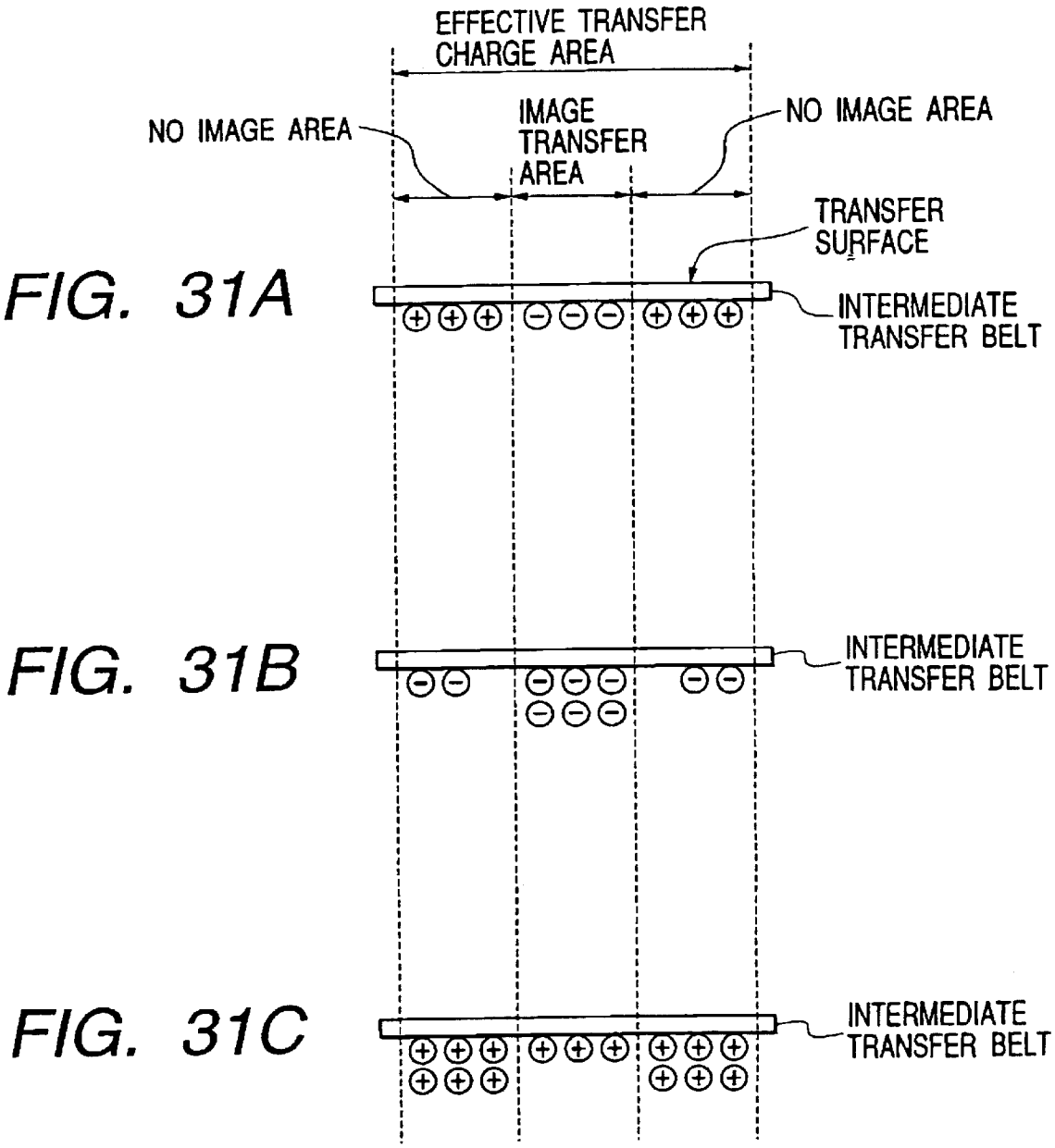
FIGS. 31A, 31B, and 31C are diagrams showing modifications of the present invention.

Therefore in this embodiment, by utilizing this phenomenon the no recording material passing portion of the intermediate transfer belt 230 is put between the charging roller 260 shown in FIG. 17 and a supporting roller 220 which is grounded before the intermediate transfer belt 230 enters into the primary transfer portion and a voltage having the same polarity (a negative voltage in this embodiment) as the normal charging polarity of the toner is applied from a high-voltage power supply E1 to the charging roller 260 so as to supply electric charges having the same polarity as for the primary transfer to an area D on a back surface of the no recording material passing portion of the intermediate transfer belt as shown in FIG. 20 (on a front surface of the no recording material passing portion, electric charges (minus) having an opposite polarity (the same polarity as for the toner) to the polarity for the primary transfer). According to it, an impedance in the primary transfer increases in the no recording material passing portion of the intermediate transfer belt, thereby reducing a decrease of transfer current of the image portion in the primary transfer caused by a low image ratio as described above. In addition, to prevent poor transfer, the intermediate transfer belt may be charged as shown in FIGS. 31A, 31B, and 31C.

Figure 21:
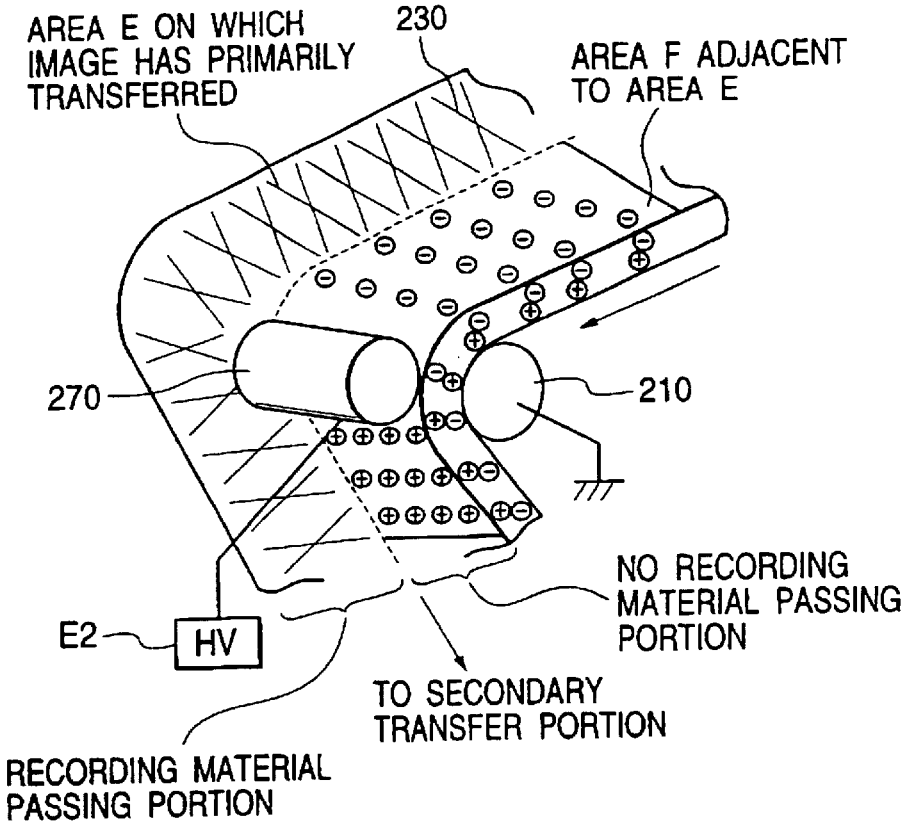
FIG. 21 is an explanatory diagram showing a supply of electric charges having an opposite polarity to a secondary transfer to the no recording material passing portion in the transfer belt performed before the secondary transfer in the present invention.

Furthermore, when the primary transfer of the four colors is completed, the no recording material passing portion of the intermediate transfer belt 230 is put between a charging roller 270 shown in FIG. 17 and a driving roller 210 which is grounded and a voltage (a positive voltage) having an opposite polarity to the normal charging polarity of the toner is applied to the charging roller 270 so as to supply electric charges (minus) having an opposite polarity to that for the secondary transfer on a back surface of an area F of the no recording material passing portion of the intermediate transfer belt as shown in FIG. 21 (on a surface of the no recording material passing portion, electric charges (plus) having the same polarity (an opposite polarity as for the toner) as the polarity for the secondary transfer). According to this, an impedance in the secondary transfer increases in the no recording material passing portion of the intermediate transfer belt, thereby resolving an insufficiency of the surface charge density of the recording material in the secondary transfer.

Figure 22:
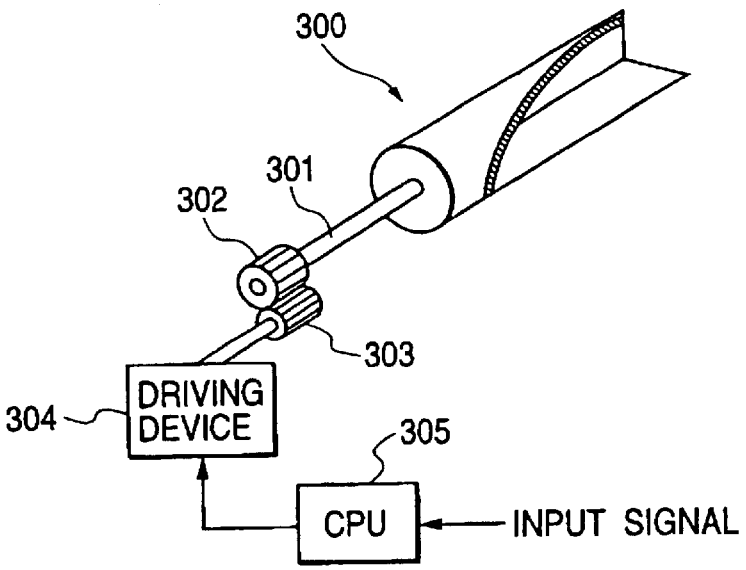
FIG. 22 is a perspective view showing a preferable modification of a roller used for supplying electric charges according to the present invention.

It is possible to use a roller 300 as shown in FIG. 22 as the charging rollers 260 and 270 so that the electric charge supply to the intermediate transfer belt 230 can be applied to recording materials having various widths (in the same manner as for FIG. 11). A conductive cylinder of the roller 300 is cut out in such a way that a cutout amount is increased in the thrust direction, so that a length in the thrust direction of the roller 300 continuously varies in a peripheral direction.

This roller 300 is enabled to rotate in the peripheral direction with an engagement of its central shaft 301 rotatably with an attachment portion which is not shown. The roller 300 is rotated by a forward and reverse rotatable motor of a driving device 304 via a gear 302 attached to an end of the central shaft 301 and a gear 303 of the driving device 304 engaging with the gear 302. Its rotation amount is controlled by a CPU 305.

In a manual recording material feeding portion or a cassette recording material feeding portion, a width of the recording material P is always detected, the recording material width information is received by the CPU 305, the CPU 305 controls a rotation angle of the motor of the driving device 304 based on the recording material width information, by which the motor of the driving device 304 rotates to rotate the roller 300 through a predetermined angle, so that a peripheral surface of the roller 300 having a length matched to a width of the no recording material passing portion of the intermediate transfer belt 230 is directed to the intermediate transfer belt 230 to abut against the no recording material passing portion of the intermediate transfer belt 230.

This roller 300 abuts against the intermediate transfer belt 230 only in forming an image on a small-sized recording material and therefore it is preferable to put it spaced from the intermediate transfer belt in other conditions.

Desirably electric charges previously stored on the intermediate transfer belt 230 do not disappear until the intermediate transfer belt reaches a residual charge eliminating process, and therefore it is preferable to select materials having a long charging relaxation time. Accordingly, a material having a high volume resistivity value, specifically $1.0\times10^{13}$ to $1.0\times10^{17}$ Ωcm, is preferable.

While it is assumed that the recording material is restricted to an end of the intermediate transfer belt in the conveying direction during conveyance in this embodiment, this invention is applicable to a condition in which the recording material is restricted to a center of the intermediate transfer belt during conveyance.

As for detecting a width of a recording material (length $\chi$ in the thrust direction), a mechanical sensor or an optical sensor may be used for an automatic discrimination or an operator may enter the width of the recording material from an operating unit or the like instead of the detecting operation.

In addition, the image bearing member is not limited to an electrophotographic photosensitive member such as a photosensitive drum, but may be a dielectric member in electrostatic recording. Furthermore, it is possible to use an intermediate transfer process in which a plurality of toner images are sequentially formed on a single photosensitive drum and the toner images are sequentially primarily transferred to an intermediate transfer member and then secondarily transferred to a recording material collectively. Still further, a single color may be used.

As a developing unit (1*a* to 1*d*), any type of a developing method may be used.

In general, developing methods are mainly classified into a mono-component development and a two-component development; there are two types of mono-component development methods such as a mono-component non-contacting development method in which toner is not put in contact with the image bearing member during development and a mono-component contacting development method in which toner is put in contact with the image bearing member during development, each after coating a development sleeve with non-magnetic toner by using a blade or the like or coating the development sleeve with magnetic toner by a magnetic force and then conveying the toner to a development portion opposite to the image bearing member with a rotation of the development sleeve, and there are two types of two-component development methods such as a two-component non-contacting development method in which developer is not put in contact with the image bearing member during development and a two-component contacting development method in which developer is put in contact with the image bearing member during development, each after coating the development sleeve with two-component developer made of toner particles mixed with magnetic carriers by a magnetic force and then conveying the developer to the developing portion by the development sleeve. The two-component contacting development method is frequently used from a viewpoint of high quality and high stability of images.

The required surface charge density on a recording material depends upon, for example, a triboelectrification charge amount (triboelectricity) of toner, a type of toner, or an installation environment of an image forming apparatus, and therefore it is preferable to associate it with these conditions.

In addition, while an area to be charged before the primary transfer and an area to be charged before the secondary transfer are the no recording material passing portion of the intermediate transfer belt 230 in this embodiment, the charge areas are not limited to this if poor transferring does not occur after the charging as described above. In this case, an amount of electric charges supplied to the no recording material passing portion should be greater than that of electric charges to the recording material passing portion.

The present invention is applicable also when a constant voltage power supply is connected to a primary transfer charger and a secondary transfer charger to control voltages applied to the primary transfer charger and the secondary transfer charger at constant voltages.

In addition, while the description has been made for an example of applying a transfer voltage to the roller 250 as the secondary transfer charger in this embodiment, the present invention is not limited to this and it is possible to have a constitution in which a transfer voltage is applied to the roller 240 and the roller 250 as an opposite electrode is grounded. In this condition, a polarity of the voltage applied to the roller 270 should be appropriately adapted so as to prevent poor transferring.

Fourth Embodiment

A constitution of this embodiment is the same as for the third embodiment, except that a charge amount by which an intermediate transfer belt 230 is previously charged before a secondary transfer is controlled according to a type of a recording material and/or a humidity (and a temperature) in an apparatus.

There is a difference in electric current flowing through a no recording material passing portion in the secondary transfer under the same environment (temperature and humidity) between a condition in use of a transparent resin sheet for an overhead projector (OHT) as a recording material and a condition in use of a plain paper, by which poor transferring sometimes occurs when is used a recording material (OHT) having a relatively high volume resistivity.

Therefore, in this embodiment, a voltage applied to a roller 270 is controlled by a CPU as control means according to a type of the recording material, by which the above poor transferring has been successfully prevented. Specifically, a voltage applied to the roller 270 in use of the OHT as a recording material is increased to be greater than that in use of the plain paper as a recording material, in order to increase a charge amount on the no recording material passing portion of the intermediate transfer belt 230.

Furthermore, even if a similar type of a recording material is used, poor transferring sometimes occurs since a volume resistivity of the recording material becomes relatively high depending on an environment (remarkable in a low humidity environment).

Therefore in this embodiment, the voltage applied to the roller 270 is controlled by the CPU according to a humidity (and a temperature) in the apparatus in addition to the control according to the above type of the recording material, by which the above poor transferring has been successfully prevented.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

an image bearing member for bearing an image;

a recording material bearing member for bearing a recording material;

first charge supplying means for supplying electric charges having a predetermined polarity to an opposite side of a surface, on which the recording material is borne, of said recording material bearing member in order to electrostatically transfer the image on said image bearing member to the recording material borne by said recording material bearing member; and second charge supplying means for supplying electric charges to the opposite side of the surface, on which the recording material is borne, of said recording material bearing member before the recording material is borne by said recording material bearing member, wherein said second charge supplying means supplies electric charges to said recording material bearing member in such a way that, in a direction substantially perpendicular to a conveying direction of the recording material, a charge amount of a second area outside a first area, for bearing the recording material, of the recording material bearing member among areas, to which electric charges are supplied by said first charge supplying means, of said recording material bearing member becomes greater than a charge amount of said first area toward said predetermined polarity.

2. An image forming apparatus according to claim 1, further comprising control means for controlling a voltage applied to said second charge supplying means according to a type of the recording material.

3. An image forming apparatus according to claim 2, further comprising recording material detecting means for detecting the type of the recording material, wherein said control means controls the voltage applied to said second charge supplying means according to a detecting result obtained by said recording material detecting means.

4. An image forming apparatus according to claim 1, further comprising control means for controlling an amount of electric charges supplied to said recording material bearing member by said second charge supplying means according to a type of the recording material.

5. An image forming apparatus according to claim 4, further comprising recording material detecting means for detecting the type of the recording material, wherein said control means controls the amount of electric charges supplied to said recording material bearing member by said second charge supplying means according to a detecting result obtained by said recording material detecting means.

6. An image forming apparatus according to claim 1, further comprising control means for controlling a voltage applied to said second charge supplying means according to a humidity.

7. An image forming apparatus according to claim 6, further comprising humidity detecting means for detecting a humidity, wherein said control means controls the voltage applied to said second charge supplying means according to a detecting result obtained by said humidity detecting means.

8. An image forming apparatus according to claim 1, further comprising control means for controlling a voltage applied to said second charge supplying means according to a temperature and a humidity.

9. An image forming apparatus according to claim 8, further comprising temperature and humidity detecting means for detecting a temperature and a humidity, wherein said control means controls the voltage applied to said second charge supplying means according to a detecting result obtained by said temperature and humidity detecting means.

10. An image forming apparatus according to claim 1, further comprising control means for controlling an amount of electric charges supplied to said recording material bearing member by said second charge supplying means according to a humidity.

11. An image forming apparatus according to claim 10, further comprising humidity detecting means for detecting a humidity, wherein said control means controls the amount of electric charges supplied to said recording material bearing member by said second charge supplying means according to a detecting result obtained by said humidity detecting means.

12. An image forming apparatus according to claim 1, further comprising control means for controlling an amount of electric charges supplied to said recording material bearing member by said second charge supplying means according to a temperature and a humidity.

13. An image forming apparatus according to claim 12, further comprising temperature and humidity detecting means for detecting a temperature and a humidity, wherein said control means controls the amount of electric charges supplied to said recording material bearing member by said second charge supplying means according to a detecting result obtained by said temperature and humidity detecting means.

14. An image forming apparatus according to claim 1, wherein no electric charges are supplied to said first area of said recording material bearing member by said second charge supplying means.

15. An image forming apparatus according to claim 1, wherein a polarity of the electric charges supplied to said first area of said recording material bearing member by said second charge supplying means is opposite to a polarity of the electric charges supplied to said recording material bearing member by said first charge supplying means.

16. An image forming apparatus according to claim 15, wherein a polarity of the electric charges supplied to said second area of said recording material bearing member by said second charge supplying means is opposite to a polarity of the electric charges supplied to said recording material bearing member by said first charge supplying means.

17. An image forming apparatus according to claim 16, wherein an absolute value of the amount of the electric charges supplied to said second area of said recording material bearing member by said second charge supplying means is smaller than an absolute value of the amount of the electric charges supplied to said first area of said recording material bearing member by said second charge supplying means.

18. An image forming apparatus according to claim 1, wherein a polarity of the electric charges supplied to said first area of said recording material bearing member by said second charge supplying means is the same as a polarity of the electric charges supplied to said recording material bearing member by said first charge supplying means.

19. An image forming apparatus according to claim 18, wherein a polarity of the electric charges supplied to said second area of said recording material bearing member by said second charge supplying means is the same as a polarity of the electric charges supplied to said recording material bearing member by said first charge supplying means.

20. An image forming apparatus according to claim 19, wherein an absolute value of the amount of the electric charges supplied to said second area of said recording material bearing member by said second charge supplying means is greater than an absolute value of the amount of the electric charges supplied to said first area of said recording material bearing member by said second charge supplying means.

21. An image forming apparatus according to claim 18, wherein a polarity of the electric charges supplied to said second area of said recording material bearing member by said second charge supplying means is opposite to a polarity of the electric charges supplied to said recording material bearing member by said first charge supplying means.

22. An image forming apparatus according to claim 1, wherein said second charge supplying means comprises a first charge supplying member for supplying electric charges to a side of the surface, on which the recording material is borne, of said recording material bearing member and a second charge supplying member, arranged opposite to said first charge supplying member through said recording material bearing member, for supplying electric charges to the opposite side of the surface, on which the recording material is borne, of said recording material bearing member.

23. An image forming apparatus according to claim 1, wherein an area in which the electric charges are supplied to said recording material bearing member by said second charge supplying means is variable according to a length of the recording material in the direction substantially perpendicular to the conveying direction of the recording material.

24. An image forming apparatus according to claim 23, wherein said second charge supplying means supplies electric charges only to said second area of said recording material bearing member in the direction substantially perpendicular to the conveying direction of the recording material.

25. An image forming apparatus according to claim 1, wherein a charging polarity of said image bearing member is opposite to said predetermined polarity.

26. An image forming apparatus according to claim 1, wherein a volume resistivity of said recording material bearing member is $10^{13}$ to $10^{17}$ Ω·cm.

27. An image forming apparatus according to claim 1, wherein images of a plurality of colors are sequentially transferred to be superposed on top of each other on the recording material borne by said recording material bearing member.

28. An image forming apparatus according to claim 27, comprising a plurality of image bearing members for bearing respective toner images of a plurality of colors, wherein the images of the plurality of colors from said plurality of said image bearing members are sequentially transferred to be superposed on top of each other on the recording material borne by said recording material bearing member.

29. An image forming apparatus, comprising:

an image bearing member for bearing an image;

an intermediate transfer member;

first charge supplying means for supplying electric charges having a predetermined polarity to an opposite side of a surface, to which the image is transferred, of said intermediate transfer member in order to electrostatically transfer the image on said image bearing member to said intermediate transfer member, wherein the image on said intermediate transfer member is transferred to a recording material; and second charge supplying means for supplying electric charges to the opposite side of the surface, to which the image is transferred, of said intermediate transfer member before the image is transferred from said image bearing member to said intermediate transfer member by said first charge supplying means;

wherein said second charge supplying means supplies electric charges to said intermediate transfer member in such a way that, in a direction substantially perpendicular to a moving direction of said intermediate transfer member, a charge amount of a second area outside a first area, to which the image is transferred, of said intermediate transfer member among areas, to which electric charges are supplied by said first charge supplying means, of said intermediate transfer member becomes greater than a charge amount of said first area toward said predetermined polarity.

30. An image forming apparatus according to claim 29, wherein a length of said second area in the direction substantially perpendicular to the moving direction of said intermediate transfer member is variable according to a length of the recording material in a direction substantially perpendicular to a conveying direction of the recording material.

31. An image forming apparatus according to claim 29, wherein a length of said second area in the direction substantially perpendicular to the moving direction of said intermediate transfer member is variable according to a length of the image to be transferred to said intermediate transfer member.

32. An image forming apparatus according to claim 30 or 31, wherein said second charge supplying means supplies electric charges only to said second area of said intermediate transfer member.

33. An image forming apparatus according to claim 32, wherein no electric charges are supplied to said first area of said intermediate transfer member by said second charge supplying means.

34. An image forming apparatus according to claim 29, wherein a polarity of the electric charges supplied to said first area of said intermediate transfer member by said second charge supplying means is opposite to a polarity of the electric charges supplied to said intermediate transfer member by said first charge supplying means.

35. An image forming apparatus according to claim 34, wherein a polarity of the electric charges supplied to said second area of said intermediate transfer member by said second charge supplying means is opposite to a polarity of the electric charges supplied to said intermediate transfer member by said first charge supplying means.

36. An image forming apparatus according to claim 35, wherein an absolute value of the amount of the electric charges supplied to said second area of said intermediate transfer member by said second charge supplying means is smaller than an absolute value of the amount of the electric charges supplied to said first area of said intermediate transfer member by said second charge supplying means.

37. An image forming apparatus according to claim 29, wherein a polarity of the electric charges supplied to said first area of said intermediate transfer member by said second charge supplying means is the same as a polarity of the electric charges supplied to said intermediate transfer member by said first charge supplying means.

38. An image forming apparatus according to claim 37, wherein a polarity of the electric charges supplied to said second area of said intermediate transfer member by said second charge supplying means is the same as a polarity of the electric charges supplied to said intermediate transfer member by said first charge supplying means.

39. An image forming apparatus according to claim 38, wherein an absolute value of the amount of the electric charges supplied to said second area of said intermediate transfer member by said second charge supplying means is greater than an absolute value of the amount of the electric charges supplied to said first area of said intermediate transfer member by said second charge supplying means.

40. An image forming apparatus according to claim 37, wherein a polarity of the electric charges supplied to said second area of said intermediate transfer member by said second charge supplying means is opposite to a polarity of the electric charges supplied to said intermediate transfer member by said first charge supplying means.

41. An image forming apparatus according to claim 29, wherein said second charge supplying means comprises a first charge supplying member for supplying electric charges to a side of the surface, to which the image is transferred, of said intermediate transfer member and a second charge supplying member, arranged opposite to said first charge supplying member through said intermediate transfer member, for supplying electric charges to the opposite side of the surface, to which the image is transferred, of said intermediate transfer member.

42. An image forming apparatus according to claim 29, wherein a volume resistivity of said intermediate transfer member is $10^{13}$ to $10^{17}$ Ω·cm.

43. An image forming apparatus according to claim 29, wherein images of a plurality of colors are sequentially transferred to be superposed on top of each other on said intermediate transfer member and the images of the plurality of colors on said intermediate transfer member are transferred to the recording material.

44. An image forming apparatus according to claim 43, comprising a plurality of image bearing members for bearing respective toner images of the plurality of colors, wherein the images of the plurality of colors from said plurality of image bearing members are sequentially transferred to be superposed on top of each other on said intermediate transfer member, and wherein said images having said plurality of colors on said intermediate transfer member are transferred to the recording material.

45. An image forming apparatus according to claim 29, wherein a charging polarity of said image bearing member is opposite to said predetermined polarity.

46. An image forming apparatus, comprising:

an image bearing member for bearing an image;

an intermediate transfer member to which the image on said image bearing member is transferred;

first charge supplying means for supplying electric charges having a predetermined polarity from a side, to which the image is transferred, of said intermediate transfer member to a recording material and said intermediate transfer member in order to transfer the image, having been transferred from said image bearing member, on said intermediate transfer member to the recording material; and second charge supplying means for supplying electric charges to the side, to which the image is transferred, of said intermediate transfer member after the image is transferred from said image bearing member to said intermediate transfer member and before the image is transferred from said intermediate transfer member to the recording material by said first charge supplying means, wherein, in a direction substantially perpendicular to a moving direction of said intermediate transfer member, said second charge supplying means supplies electric charges having said predetermined polarity to only a second area, outside a first area to which the image has been transferred, to which electric charges are supplied by said first charge supplying means, of said intermediate transfer member.

47. An image forming apparatus according to claim 46, further comprising control means for controlling a voltage applied to said second charge supplying means according to a type of the recording material.

48. An image forming apparatus according to claim 47, further comprising recording material detecting means for detecting a type of the recording material, wherein said control means controls the voltage applied to said second charge supplying means according to a detecting result obtained by said recording material detecting means.

49. An image forming apparatus according to claim 46, further comprising control means for controlling an amount of electric charges supplied to said intermediate transfer member by said second charge supplying means according to a type of the recording material.

50. An image forming apparatus according to claim 49, further comprising recording material detecting means for detecting a type of the recording material, wherein said control means controls an amount of electric charges supplied to said intermediate transfer member by said second charge supplying means according to a detecting result obtained by said recording material detecting means.

51. An image forming apparatus according to claim 46, further comprising control means for controlling a voltage applied to said second charge supplying means according to a humidity.

52. An image forming apparatus according to claim 51, further comprising humidity detecting means for detecting a humidity, wherein said control means controls the voltage applied to said second charge supplying means according to a detecting result obtained by said humidity detecting means.

53. An image forming apparatus according to claim 46, further comprising control means for controlling a voltage applied to said second charge supplying means according to a temperature and a humidity.

54. An image forming apparatus according to claim 53, further comprising temperature and humidity detecting means for detecting a temperature and a humidity, wherein said control means controls the voltage applied to said second charge supplying means according to a detecting result obtained by said temperature and humidity detecting means.

55. An image forming apparatus according to claim 46, further comprising control means for controlling an amount of electric charges supplied to said intermediate transfer member by said second charge supplying means according to a humidity.

56. An image forming apparatus according to claim 55, further comprising humidity detecting means for detecting a humidity, wherein said control means controls an amount of electric charges supplied to said intermediate transfer member by said second charge supplying means according to a detecting result obtained by said humidity detecting means.

57. An image forming apparatus according to claim 46, further comprising control means for controlling an amount of electric charges supplied to said intermediate transfer member by said second charge supplying means according to a temperature and a humidity.

58. An image forming apparatus according to claim 57, further comprising temperature and humidity detecting means for detecting a temperature and a humidity, wherein said control means controls an amount of electric charges supplied to said intermediate transfer member by said second charge supplying means according to a detecting result obtained by said temperature and humidity detecting means.

59. An image forming apparatus according to claim 46, wherein no electric charges are supplied to said first area of said intermediate transfer member by said second charge supplying means.

60. An image forming apparatus according to claim 46, wherein said second charge supplying means comprises a first charge supplying member for supplying electric charges to the side, to which the image is transferred, of said intermediate transfer member and a second charge supplying member, arranged opposite to said first charge supplying member through said intermediate transfer member, for supplying electric charges to an opposite side of the side, to which the image is transferred, of said intermediate transfer member.

61. An image forming apparatus according to claim 46, wherein a length of said second area is variable according to a length of the recording material in a direction substantially perpendicular to a conveying direction of the recording material.

62. An image forming apparatus according to claim 61, wherein said second charge supplying means supplies electric charges only to said second area.

63. An image forming apparatus according to claim 46, wherein a charging polarity of said image bearing member is opposite to said predetermined polarity.

64. An image forming apparatus according to claim 46, wherein a volume resistivity of said intermediate transfer member is $10^{13}$ to $10^{17}$ Ω·cm.

65. An image forming apparatus according to claim 46, further comprising third charge supplying means for supplying electric charges to an opposite side of the side to which the image is transferred, of said intermediate transfer member in order to transfer the image on said image bearing member to said intermediate transfer member and fourth charge supplying means for supplying electric charges to the opposite side of the side, to which the image is transferred, of said intermediate transfer member before the image is transferred from said image bearing member to said intermediate transfer member by said third charge supplying means, wherein said fourth charge supplying means supplies electric charges to said intermediate transfer member in such a way that, in the direction substantially perpendicular to the moving direction of said intermediate transfer member, a charge amount of a fourth area outside a third area, to which the image is transferred, of said intermediate transfer member among areas, to which electric charges are supplied by said third charge supplying means, of said intermediate transfer member becomes greater than a charge amount of said third area toward said predetermined polarity.

66. An image forming apparatus according to claim 46, wherein images of a plurality of colors are sequentially transferred go be superposed on top of each other on said intermediate transfer member and the images of the plurality of colors on said intermediate transfer member are transferred to the recording material.

67. An image forming apparatus according to claim 66, comprising a plurality of image bearing members for bearing respective toner images of the plurality of colors, wherein the images of the plurality of colors from the plurality of said image bearing members are sequentially transferred to be superposed on top of each other on said intermediate transfer member and the image of the plurality of colors on said intermediate transfer member are transferred to the recording material.

68. An image forming apparatus, comprising:

an image bearing member for bearing an image;

an intermediate transfer member to which the image on said image bearing member is transferred;

first charge supplying means for supplying electric charges having a predetermined polarity to an opposite side of a side, to which the image is transferred, of said intermediate transfer member in order to electrostatically transfer the image, having transferred from said image bearing member, on said intermediate transfer member to a recording material; and second charge supplying means for supplying electric charges to the opposite side of the side, to which the image is transferred, of said intermediate transfer member after the image is transferred from said image bearing member to said intermediate transfer member and before the image is transferred from said intermediate transfer member to the recording material by said first charge supplying means, wherein, in a direction substantially perpendicular to a moving direction of said intermediate transfer member, said second charge supplying means supplies electric charges having said predetermined polarity to only a second area, outside a first area to which the image has been transferred, to which electric charges are supplied by said first charge supplying means, of said intermediate transfer member.

69. An image forming apparatus according to claim 68, further comprising control means for controlling a voltage applied to said second charge supplying means according to a type of the recording material.

70. An image forming apparatus according to claim 69, further comprising recording material detecting means for detecting a type of the recording material, wherein said control means controls a voltage applied to said second charge supplying means according to a detecting result obtained by said recording material detecting means.

71. An image forming apparatus according to claim 68, further comprising control means for controlling an amount of electric charges supplied to said intermediate transfer member by said second charge supplying means according to a type of the recording material.

72. An image forming apparatus according to claim 71, further comprising recording material detecting means for detecting a type of the recording material, wherein said control means controls the amount of electric charges supplied to said intermediate transfer member by said second charge supplying means according to a detecting result obtained by said recording material detecting means.

73. An image forming apparatus according to claim 68, further comprising control means for controlling a voltage applied to said second charge supplying means according to a humidity.

74. An image forming apparatus according to claim 73, further comprising humidity detecting means for detecting a humidity, wherein said control means controls the voltage applied to said second charge supplying means according to a detecting result obtained by said humidity detecting means.

75. An image forming apparatus according to claim 68, further comprising control means for controlling a voltage applied to said second charge supplying means according to a temperature and a humidity.

76. An image forming apparatus according to claim 75, further comprising temperature and humidity detecting means for detecting a temperature and a humidity, wherein said control means controls the voltage applied to said second charge supplying means according to a detecting result obtained by said temperature and humidity detecting means.

77. An image forming apparatus according to claim 68, further comprising control means for controlling an amount of electric charges supplied to said intermediate transfer member by said second charge supplying means according to a humidity.

78. An image forming apparatus according to claim 77, further comprising humidity detecting means for detecting a humidity, wherein said control means controls the amount of electric charges supplied to said intermediate transfer member by said second charge supplying means according to a detecting result obtained by said humidity detecting means.

79. An image forming apparatus according to claim 68, further comprising control means for controlling an amount of electric charges supplied to said intermediate transfer member by said second charge supplying means according to a temperature and a humidity.

80. An image forming apparatus according to claim 79, further comprising temperature and humidity detecting means for detecting a temperature and a humidity, wherein said control means controls the amount of electric charges supplied to said intermediate transfer member by said second charge supplying means according to a detecting result obtained by said temperature and humidity detecting means.

81. An image forming apparatus according to claim 68, wherein no electric charges are supplied to said first area by said second charge supplying means.

82. An image forming apparatus according to claim 68, wherein said second charge supplying means comprises a first charge supplying member for supplying electric charges to the side, to which the image is transferred, of said intermediate transfer member and a second charge supplying member, arranged opposite to said first charge supplying member through said intermediate transfer member, for supplying electric charges to the opposite side of the side, to which the image is transferred, of said intermediate transfer member.

83. An image forming apparatus according to claim 68, wherein a length of said second area is variable according to a length of the recording material in a direction substantially perpendicular to a conveying direction of the recording material.

84. An image forming apparatus according to claim 83, wherein said second charge supplying means supplies electric charges only to said second area.

85. An image forming apparatus according to claim 68, wherein a charging polarity of said image bearing member is opposite to said predetermined polarity.

86. An image forming apparatus according to claim 68, wherein a volume resistivity of said intermediate transfer member is $10^{13}$ to $10^{17}$ Ω·cm.

87. An image forming apparatus according to claim 68, further comprising third charge supplying means for supplying electric charges to the opposite side of the side, to which the image is transferred, of said intermediate transfer member in order to transfer the image on said image bearing member to said intermediate transfer member and fourth charge supplying means for supplying electric charges to the opposite side of the side, to which the image is transferred, of said intermediate transfer member before the image is transferred from said image bearing member to said intermediate transfer member by said third charge supplying means, wherein said fourth charge supplying means supplies electric charges to said intermediate transfer member in such a way that, in the direction substantially perpendicular to the moving direction of said intermediate transfer member, a charge amount of a fourth area outside a third area, to which the image is transferred, of said intermediate transfer member among areas, to which electric charges are supplied by said third charge supplying means, of said intermediate transfer member becomes greater than a charge amount of said third area toward a polarity of the electric charges supplied by said third charge supplying means.

88. An image forming apparatus according to claim 68, wherein images of a plurality of colors are sequentially transferred to be superposed on top of each other on said intermediate transfer member and the images of the plurality of colors on said intermediate transfer member are transferred to the recording material.

89. An image forming apparatus according to claim 88, comprising a plurality of image bearing members for bearing respective toner images of the plurality of colors, wherein the images of the plurality of colors from said plurality of the image bearing members are sequentially transferred to be superposed on top of each other on said intermediate transfer member, and the images of the plurality of colors on said intermediate transfer member are transferred to the recording material.

* * * * *

UNITED STATES PATENT AND TRADEMARK OFFICE

CERTIFICATE OF CORRECTION

PATENT NO. : 6,347,209 B1
DATED : February 12, 2002
INVENTOR(S) : Yuji Bessho

It is certified that error appears in the above-identified patent and that said Letters Patent is hereby corrected as shown below:

Column 1,
Line 14, “there are” should read -- there is --.

Column 8,
Line 40, “polyvinil-” should read -- polyvinyl- --.

Column 9,
Line 47, “polyvinilidene” should read -- polyvinylidene --.

Column 12,
Line 40, “en” should read -- an --.

Column 17,
Line 35, “polyvinilidene” should read -- polyvinylidene --.

Column 18,
Line 45, “polyvinilidene” should read -- polyvinylidene. --.

Column 19,
Line 3, “polphenylene sulfide” should read -- polyphenylene sulfide --.

Column 23,
Line 32, “area” should read -- area, --;
Line 33, “area,” should read -- area --; and “of the” should be deleted; and
Line 34, “recording material bearing member among areas,” should be deleted.

Column 26,
Line 17, “area” should read -- area, --;
Line 18, “area,” should read -- area --; and “of” should be deleted; and
Line 19, “said intermediate transfer member among areas,” should be deleted.

UNITED STATES PATENT AND TRADEMARK OFFICE

CERTIFICATE OF CORRECTION

PATENT NO. : 6,347,209 B1
DATED : February 12, 2002
INVENTOR(S) : Yuji Bessho

It is certified that error appears in the above-identified patent and that said Letters Patent is hereby corrected as shown below:

Column 29,
Line 64, "go be" should read -- to be --.

Signed and Sealed this

Tenth Day of December, 2002

JAMES E. ROGAN
*Director of the United States Patent and Trademark Office*